US009193498B2

(12) United States Patent
Matsuoka

(10) Patent No.: US 9,193,498 B2
(45) Date of Patent: Nov. 24, 2015

(54) FOLDABLE CONTAINER

(71) Applicant: DAIICHI OHMIYA CO., LTD., Osaka (JP)

(72) Inventor: Takamine Matsuoka, Osaka (JP)

(73) Assignee: DAIICHI OHMIYA CO., LTD., Osaka (JP)

( * ) Notice: Subject to any disclaimer, the term of this patent is extended or adjusted under 35 U.S.C. 154(b) by 0 days.

(21) Appl. No.: 14/368,934

(22) PCT Filed: Oct. 31, 2012

(86) PCT No.: PCT/JP2012/078155
§ 371 (c)(1),
(2) Date: Jun. 26, 2014

(87) PCT Pub. No.: WO2014/068699
PCT Pub. Date: May 8, 2014

(65) Prior Publication Data

US 2015/0028028 A1 Jan. 29, 2015

(51) Int. Cl.
*B65D 6/24* (2006.01)

(52) U.S. Cl.
CPC ..... *B65D 11/1893* (2013.01)

(58) Field of Classification Search
CPC ..... B65D 11/18; B65D 11/1833; B65D 11/1866; B65D 11/1893; B65D 6/18
USPC ..... 206/600; 220/1.5, 4.28, 4.33, 6, 62.1, 220/639, 646, 7; 229/117.02, 125.28
See application file for complete search history.

(56) References Cited

U.S. PATENT DOCUMENTS 3,409,202 A * 11/1968 Belcher ..... 220/4.28
3,649,398 A * 3/1972 Keith ..... 156/79
4,210,274 A * 7/1980 Leonard ..... 229/198.1
4,492,153 A * 1/1985 Grabowski ..... 99/460

(Continued)

FOREIGN PATENT DOCUMENTS

JP 6-22226 U 3/1994
JP 08-002524 A 1/1996

(Continued)

OTHER PUBLICATIONS

International Search Report for PCT Patent App. No. PCT/JP2012/078155 (Jan. 15, 2013).

(Continued)

*Primary Examiner* — Anthony Stashick
*Assistant Examiner* — Kaushikkumar Desai
(74) *Attorney, Agent, or Firm* — Cermak Nakajima & McGowan LLP; Tomoko Nakajima

(57) ABSTRACT

A plastic corrugated folding container is provided wherein box body assembly can be performed without catching of the latch side panels on column members, the four corners of the box body can be closed tightly, and during folding, lid members, partitioning panels, or similar can be stored. A heating bar set to a prescribed temperature is applied to folding lines of a floor panel, and side panels and latch side panels thereby rise up due to heating and melting. A heating bar set to a prescribed temperature is applied to folding lines in the lower parts of a pair of second side panels, and an engaging piece is bent outwards by heating and melting; an engaging piece of the second side panel is configured to engage with an engaging hole in the latch side panel, and a box body having a floor that does not sag can be provided.

3 Claims, 25 Drawing Sheets

(56) References Cited

U.S. PATENT DOCUMENTS

| | | | | |
|---|---|---|---|---|
| 7,886,778 | B2 * | 2/2011 | McDowell | 141/10 |
| 8,499,954 | B2 * | 8/2013 | Tang | 220/4.01 |
| 2003/0234252 | A1 * | 12/2003 | Howard | 220/62.1 |
| 2008/0312054 | A1 * | 12/2008 | Boland | 493/102 |

FOREIGN PATENT DOCUMENTS

| | | | | |
|---|---|---|---|---|
| JP | 2002-114275 | A | | 4/2002 | |
| JP | 3098273 | U | | 9/2003 | |
| JP | 2004161295 | A | * | 6/2004 | B65D 5/44 |
| JP | 3164095 | U | | 10/2010 | |

OTHER PUBLICATIONS

Written Opinion for PCT Patent App. No. PCT/JP2012/078155 (Jan. 15, 2013) with English translation thereof.

International Preliminary Report on Patentability for PCT Patent App. No. PCT/JP2012/078155 (Jan. 21, 2014) with English translation thereof.

* cited by examiner

FIG. 1
(A)
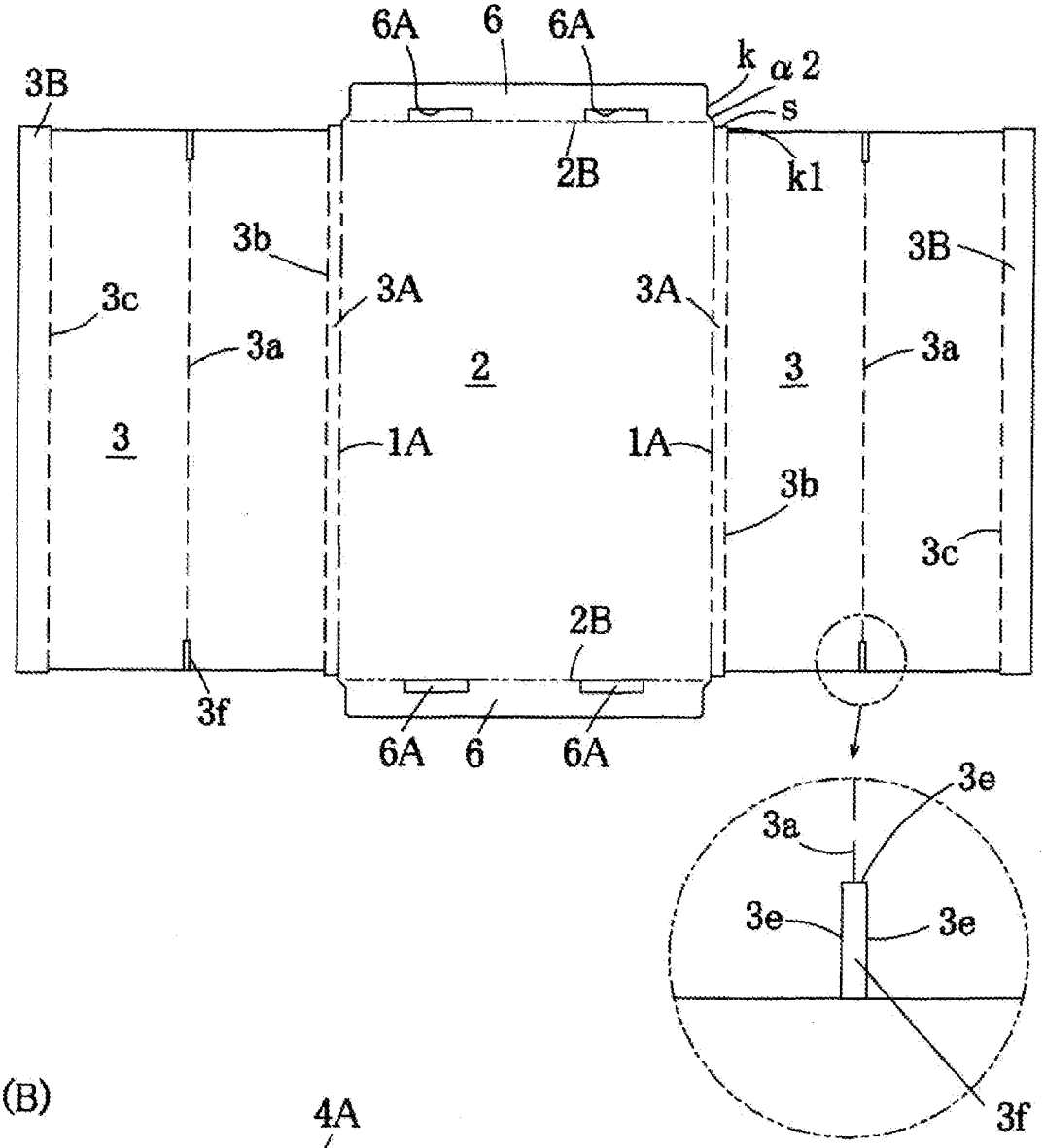
(B)
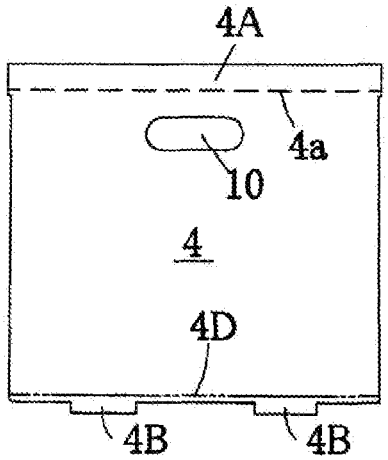

FIG. 10
(A)
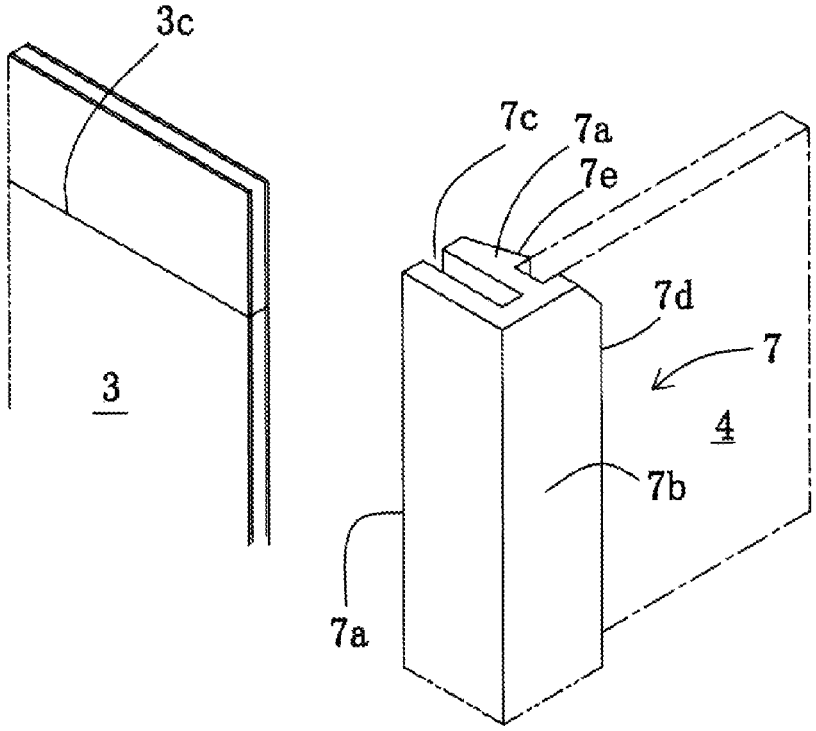
(B)
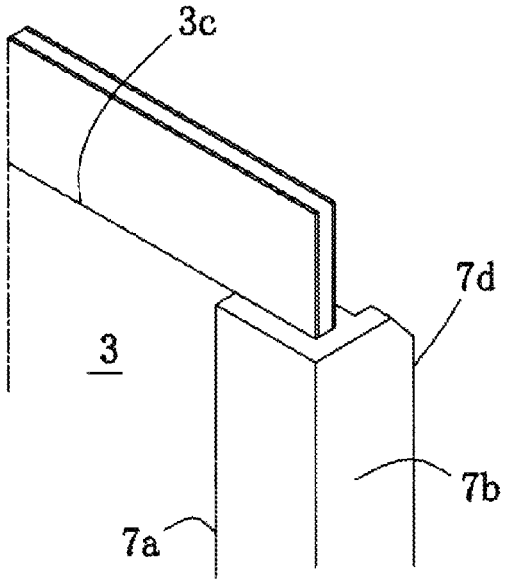

Conventional Art

FIG. 15
(A)
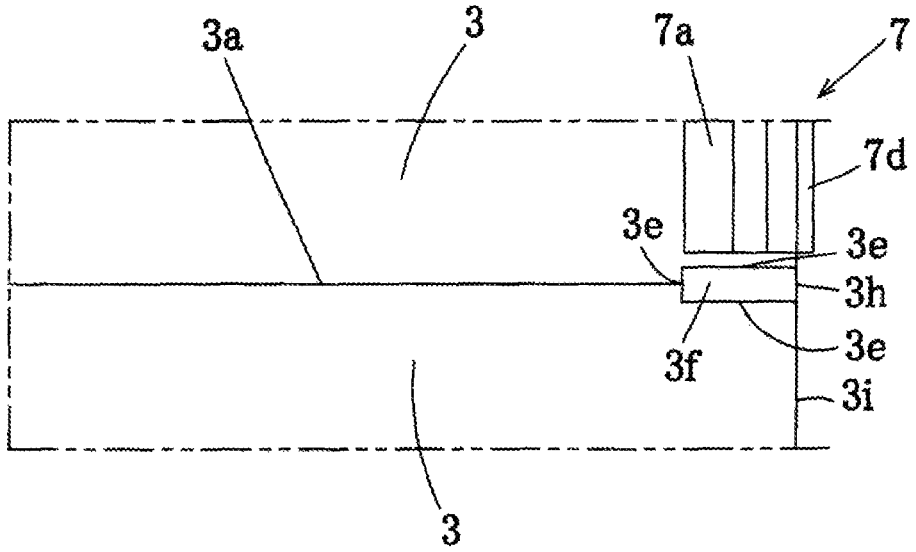
(B)
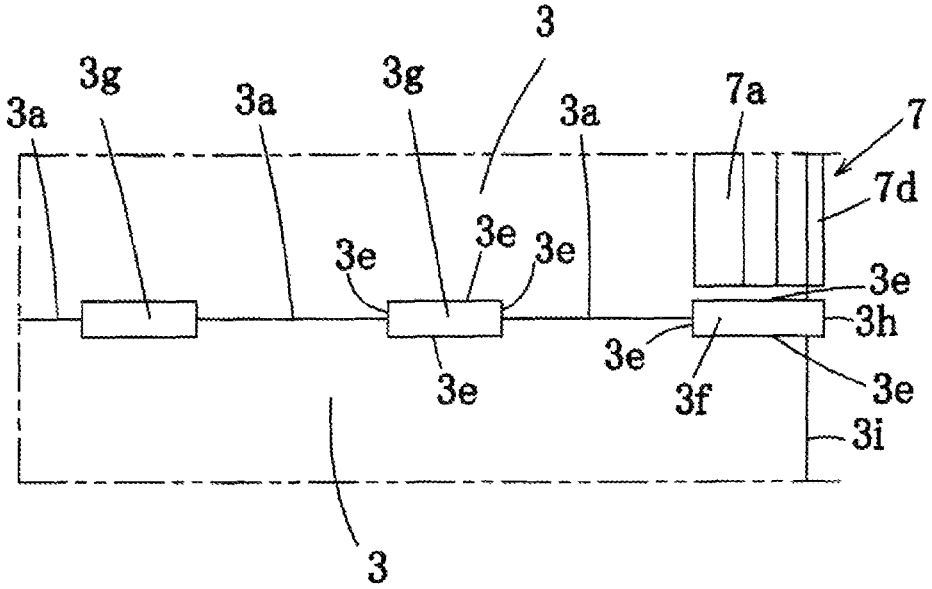

FIG. 17
(A)
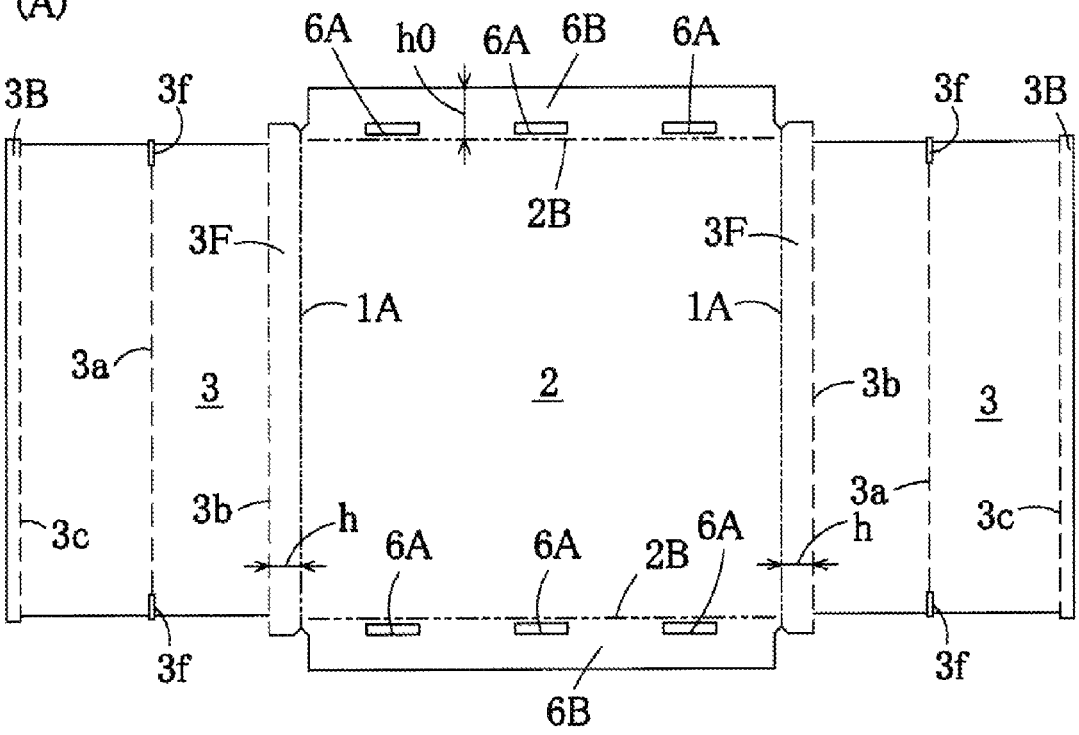
(B)
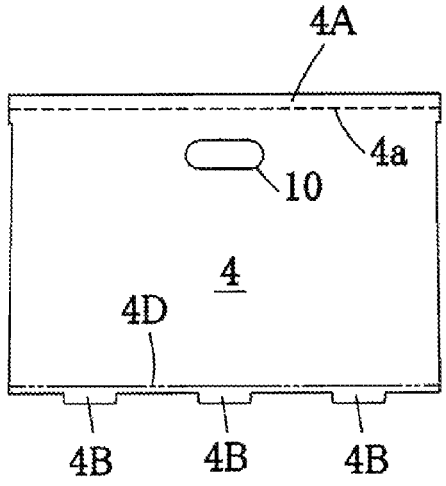

FIG. 18
(A)
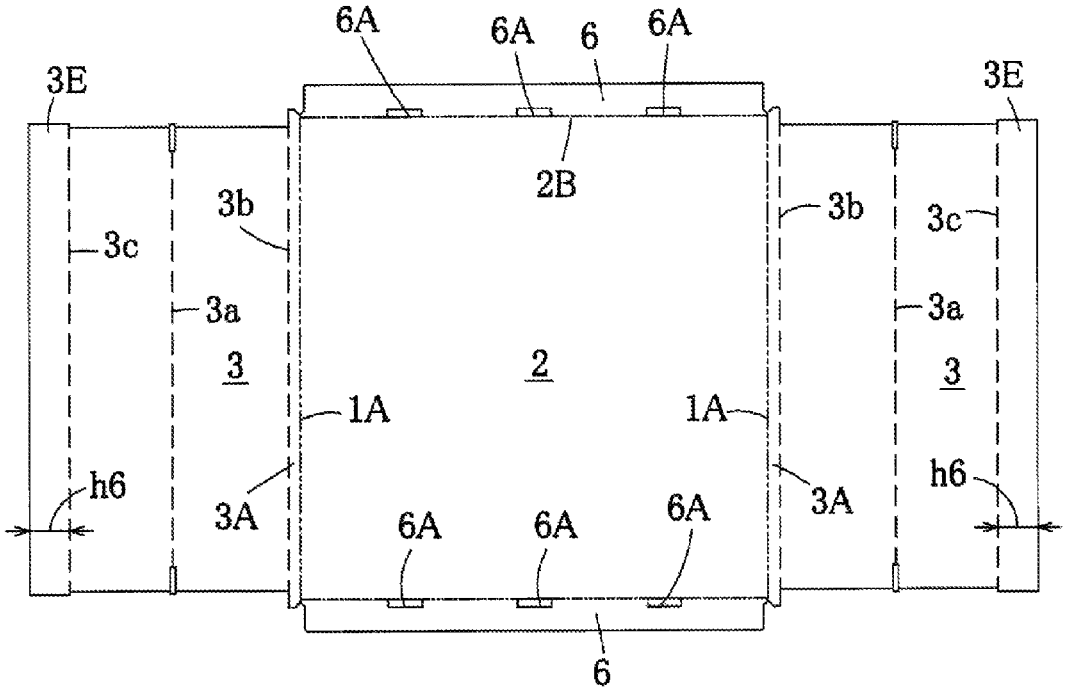
(B)
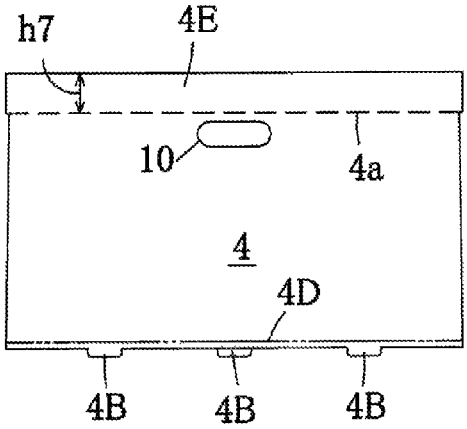

FIG. 23
(A)
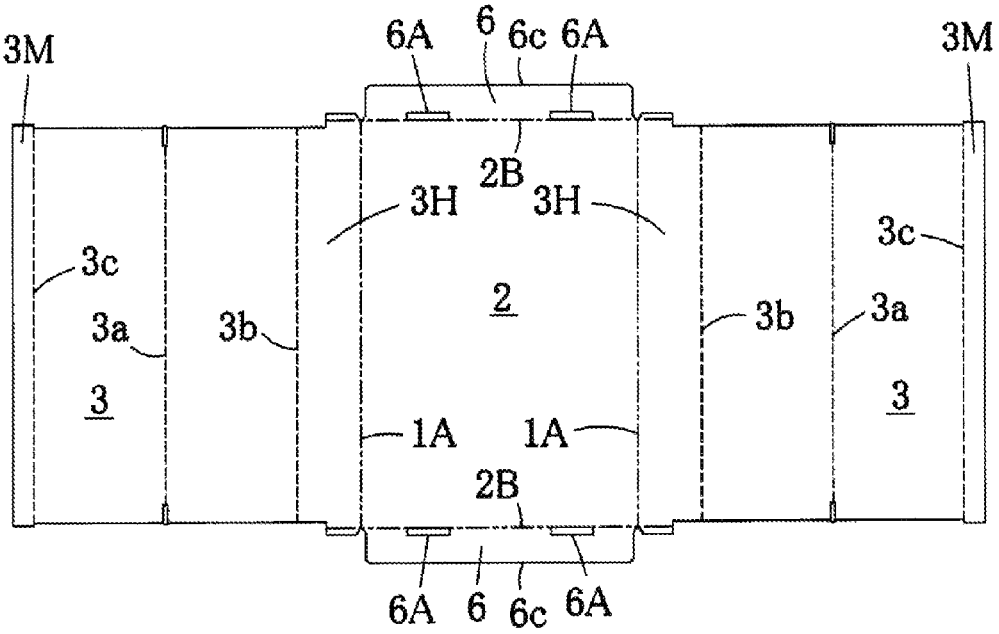
(B)
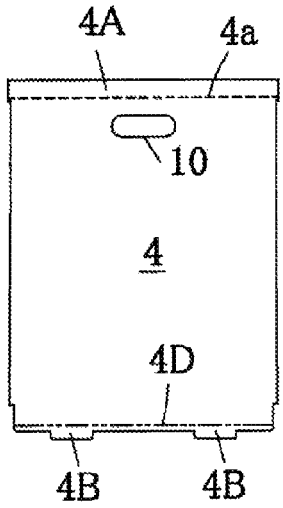

FIG. 24
(C)
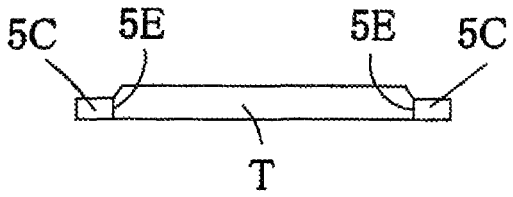
(D)
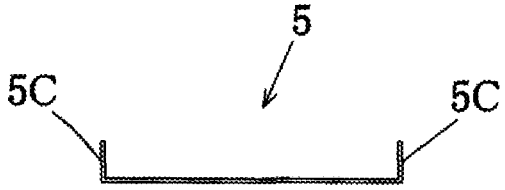

FIG. 25
(E)
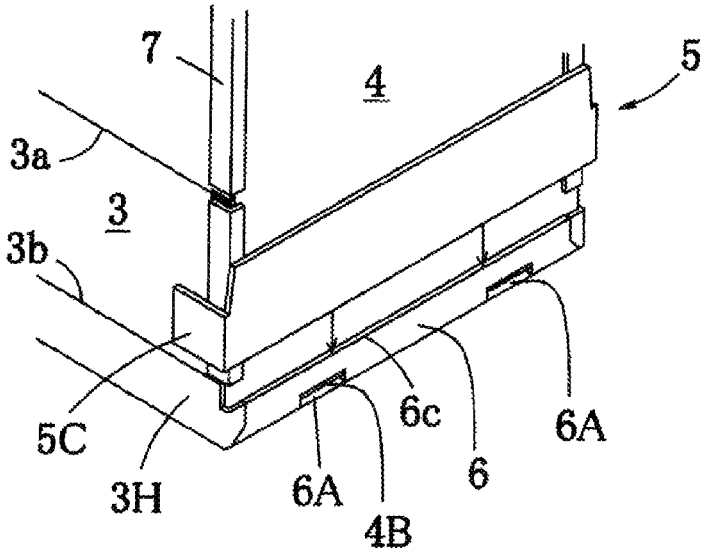
(F)
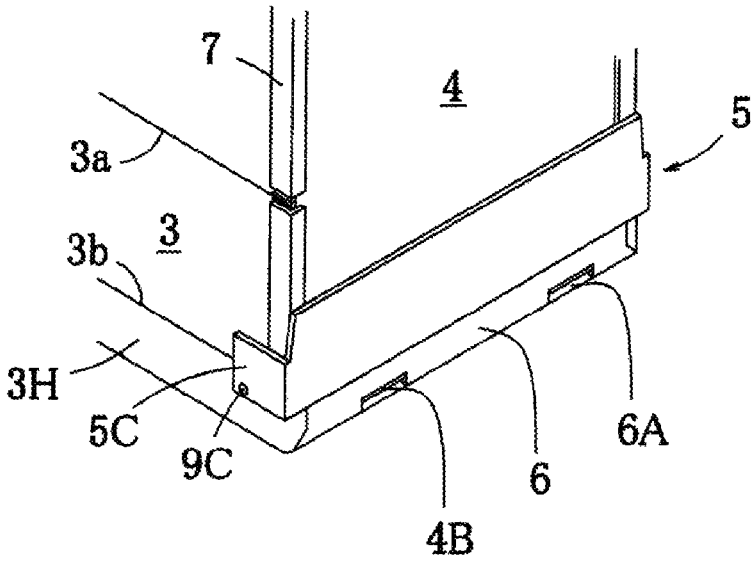

FIG. 26
(C)
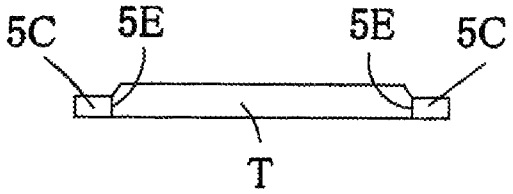
(D)
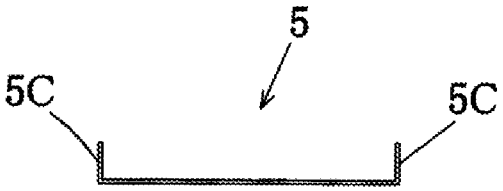

FIG. 27
(C)
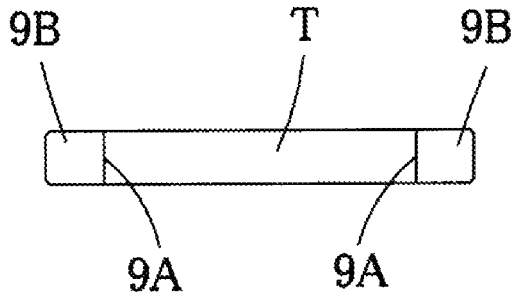
(D)
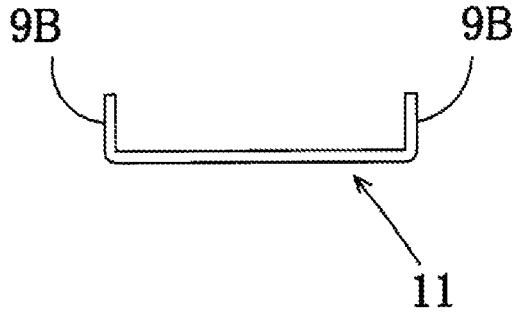
(E)
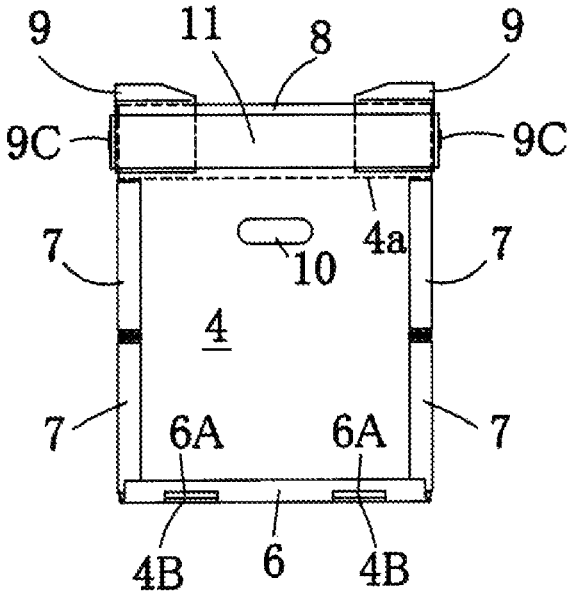

FOLDABLE CONTAINER

This application is a national phase entry under 35 U.S.C. §371 of PCT Patent Application No. PCT/JP2012/078155, filed on Oct. 31, 2012, which is incorporated by reference.

TECHNICAL FIELD

The present invention relates to a folding container that can be folded and assembled. In particular, the present invention relates to a plastic corrugated folding container for use when transporting or conveying products.

TECHNICAL BACKGROUND

In the prior art, folding containers using corrugated plastic and having such properties as water resistance and durability compared with corrugated paper materials have been widely used for the storage and transportation of industrial products, items/commodities, and the like.

Folding containers using corrugated plastic, having a floor panel integrally provided with a latch panel and with a hook and loop fastener installed on the latch panel to enable attaching to and detaching from a side panel, are publicly known (see, for example, Patent Document 1).

PRIOR ARTS LIST

Patent Document 1: Japanese Registered Utility Model No. 3098273

SUMMARY OF THE INVENTION

Problems to be Solved by the Invention

However, the folding container disclosed in the above publication of the prior art is formed from corrugated plastic in which a sheet material is bonded to the obverse and reverse face sides of a wave-shape core, with vertical corrugation.

In order to bend right- and left-side panels and front and back latch panels with respect to the floor panel, a configuration is used in which an incision is formed to midway in the thickness direction (a configuration in which one liner of the corrugated plastic is left and the other liner and the core are cut, or a configuration in which a notch is formed without severing the non-foamed plastic panel).

Hence, if an incision is formed to midway in the thickness direction at the four edges of the floor panel of the box, the floor panel and side panels become hinge-like at the bending places due to the incisions to midway in the thickness direction, and the floor panel and side panels are not mutually immobilized, but are always in a bendable state. The floor panel and the side panels swing so as to open and close, and consequently there is the issue that the floor of the box body assumes a sagging state, and the strength of the box body is reduced.

Further, the places at which incisions are made to midway in the thickness direction must always be to midway in the thickness direction along the vertical corrugation, but limits are imposed by the directional properties of the material.

Portions at which such incisions to midway in the thickness direction are made are also formed at intermediate positions in the height direction of the left- and right-side panels, and the above issue therefore extends to the entirety of conventional folding containers.

Moreover, when folding a folding container, by pressing on the frame from above the box body, a column member may be twisted and brought into contact with an end part of a latch panel, and a tip portion of the abutting piece of the column member may ride up onto an end part of the latch panel. In such a case, a rod-shape object or a finger must be used to separate the abutting piece of the column member that has ridden up onto the latch side panel. Consequently, there has been the issue that folding cannot be performed smoothly, and folding the box body is troublesome.

Further, bending is performed while applying a heating bar at folding lines on both ends of the latch panel to form the box body. In order to keep the heating bar from making contact, an inclined end part at an angle of approximately 45° must be formed at both ends of the latch side panel. Consequently, if a configuration is used in which an end face corner of the latch side panel and an end face corner of a lower short panel intersect, the four corners of the folding container are not closed tightly, and there has been the concern that dirt, dust, or insects may enter.

The present invention can provide a folding container that can address the above issues, affording efficient assembly and folding, capable of storing accessories, and in which sagging of the floor does not occur and there is no bulging of the folding container in the folded state.

The present invention was devised in the light of the above circumstances, and provides, As means for addressing the problems, a superior folding container in which sagging of the floor does not occur as in the case of conventional folding containers using corrugated plastic, which is strong, folding of the box body of which is not troublesome, and in which there is no entry of dirt, dust or insects from the four corners of the folding container.

Further, the present invention provides, As means for addressing the problems, a superior folding container that is the above-described folding container in which the efficiency during folding is satisfactory and which can store accessories, with no bulging of the folding container in the folded state.

Means to Solve the Problems

As means for addressing the problems, the invention according to a first aspect of the present invention provides a plastic corrugated folding container comprising:

a first side panel (3), provided connectedly to each of two sides of a floor panel (2), with a folding line (1A) interposed therebetween, provided with a lower short side panel (3A), with an incision (3*b*) interposed therebetween, and provided with an upper short side panel (3B), with an incision (3*c*) interposed therebetween, wherein an incision (3*a*) is formed at a position midway in the height direction of each first side panel (3) excluding the lower short side panel (3A) and the upper short side panel (3B);

a latch side panel (6) having an engaging hole (6A, 6A), formed on each of two ends of the floor panel (2), with a folding line (2B) interposed therebetween;

a pair of second side panels (4) attached to the floor panel (2), wherein an upper part piece (4A) is formed on an upper part of each second side panel with an incision (4*a*) interposed therebetween, and an engaging piece (4B, 4B) is provided on a lower part of each second side panel with a folding line (4D) interposed therebetween;

column members (7) for supporting end parts of the first side panels (3), wherein each column member has a sandwiching piece (7*a*) provided with a stopper (7*e*) and being substantially U-shaped in cross section, a connecting piece (7*b*), and an abutting piece (7*d*) continuous with the connecting piece (7*b*), each column member (7) is separated into upper and lower column members across the incision (3*a*) of each first side panel (3), and end parts of each first side panels (3) are firmly fixed by being sandwiched in the column members (7), wherein each of the incisions enables flat folding, a horizontal face (k1) and a vertical face (s) are provided at both ends of the lower short side panel (3A) of each first side panel (3), an inclined face (α2) and a vertical face (k) are formed at both ends of each latch side panel (6) for the floor panel (2), the first side panels (3, 3) and the latch side panels (6, 6) are configured to bend in an inward direction, by applying a heating bar set to a prescribed temperature to each of the folding lines (1A) and each of the folding lines (2B) of the floor panel (2) and, the engaging pieces (4B) are configured to bend in an outward direction, by applying a heating bar set to a prescribed temperature to the folding line (4D) of each second side panels (4), and the engaging piece (4B) of each second side panel (4) is configured to engage with each engaging hole (6A) of the latch side panel (6), to form a box body.

As means for addressing the problems, the invention according to a second aspect is the plastic corrugated folding container according to the first aspect, a trapezoidal bending piece (3C), having an inclined face (α3), a vertical face (s), and a horizontal face (k2), is protrudingly provided at both ends of the lower short side panel (3A) of each first side panel (3), with a folding line (3D) interposed therebetween;

the inclined face (α2) and the vertical face (k) are formed at both ends of each latch side panel (6) for the floor panel (2);

the first side panels (3) and the latch side panels (6) which are provided at the floor panel (2) are configured to bend in the inward direction, by applying a heating bar set to a prescribed temperature to each of the folding lines (1A) and each of the folding lines (2B);

the engaging pieces (4B) are configured to bend in the outward direction, by applying a heating bar set to a prescribed temperature to the folding line (4D) of each second side panel (4); and the bending pieces (3C) formed at both ends of each lower short side panel (3A) are configured to bend in the inward direction, by applying a heating bar set to a prescribed temperature to the folding lines (3D), and each end face portion of the inclined face (α2) and the inclined face (α3) and each end face portion of the vertical face (k) and of the vertical face (s) are heat-fused and welded.

As means for addressing the problems, the invention according to a third aspect is the folding container according to the first aspect, the incision (3*a*) for folding is provided in each first side panel (3), a face panel portion (3*f*) is formed at both end parts of each incision (3*a*) by making an incision (3*e*, 3*e*, 3*e*) enclosing three sides of the periphery and leaving inside and outside faces of each first side panel, and a tip (3*h*) of the face panel portion (3*f*) and an end face edge (3*i*) of each first side panel (3) are formed in substantially a same plane.

As means for addressing the problems, the invention according to a fourth aspect is the folding container according to the first aspect, the incision (3*a*) for folding is provided in each first side panel (3), a face panel portion (3*f*) is formed at both end parts of each incision (3*a*) by making an incision (3*e*, 3*e*, 3*e*) enclosing three sides of the periphery and leaving inside and outside faces of each side panel, and a tip (3*h*) of the face panel portion (3*f*) and the abutting piece (7*d*) of each column member (7) is formed in substantially a same plane.

As means for addressing the problems, the invention according to a sixth aspect is the folding container according to the first aspect, each first side panel (3) is provided on both sides of the floor panel (2), with the folding line (1A) interposed therebetween, each first side panel (3) is provided with a lower short side panel (3F), with the incision (3*b*) interposed therebetween, each first side panels (3) is provided with each upper short side panel (3B), with the incision (3*c*) interposed therebetween, each incision (3*a*) is formed at a position midway in the height direction of each first side panel (3) excluding the lower short side panel (3F) and the upper short side panel (3B), and a height (h0) of a latch side panel (6B) corresponds to a height (h) of the lower short side panel (3F) to form a storage part on the floor panel (2) in a folded state.

As means for addressing the problems, the invention according to a seventh aspect is the folding container according to the first aspect, each first side panel (3) is provided on both sides of the floor panel (2), with the folding line (1A) interposed therebetween, each first side panel (3) is provided with each lower short side panel (3A), with the incision (3*b*) interposed therebetween, each first side panel (3) is provided with an upper short side panel (3E), with the incision (3*c*) interposed therebetween, and each incision (3*a*) is formed at a position midway in the height direction of the first side panels (3) excluding the lower short side panel (3A) and the upper short side panel (3E), and an upper part piece (4E) in which a height (h7) is increased is provided in each second side panel (4) corresponding to a height (h6) of the upper short side panel (3E), with each incision (4*a*) interposed therebetween, to provide a storage part on the second side panels (4, 4) in a folded state.

As means for addressing the problems, the invention according to a ninth aspect is the folding container according to the first aspect, each first side panel (3) is provided on both sides of the floor panel (2), with the folding line (1A) interposed therebetween, each first side panel (3) is provided with a lower short side panel (3H), with the incision (3*b*) interposed therebetween, each first side panel (3) is provided with an upper short side panel (3M), with the incision (3*c*) interposed therebetween, the incision (3*a*) is formed at a position midway in the height direction of the first side panels (3) excluding the lower short side panel (3H) and the upper short side panel (3M), and the plastic corrugated folding container further comprising:

a joining piece (5), placed on an end face (6*c*) of each latch side panels (6), and having a plastic corrugated plate shape panel (T) and a side piece (5C, 5C) extending perpendicularly from both sides of the plate shape panel, with a folding line (5E, 5E) interposed therebetween, and bending the side pieces (5C, 5C) in an inward direction, wherein each joining piece (5) is placed on the end face of each latch side panels (6) for the floor panel (2), and the side pieces (5C) of each joining piece (5) are firmly fixed to the lower short side panel (3H) of each first side panel (3), and when folded, a storage portion reinforcing a lower part of a box body is formed.

As means for addressing the problems, the invention according to a tenth aspect is the folding container according to the first aspect, each first side panel (3) is provided on both sides of the floor panel (2), with the folding line (1A) interposed therebetween, each first side panel (3) is provided with the lower short side panels (3A), with the incisions (3*b*) interposed therebetween, each first side panel (3) is provided with the upper short side panel (3J) is provided, with the incision (3*c*) interposed therebetween, the incision (3*a*) is formed at a position midway in the height direction of the first side panels (3) excluding the height (h5) of the lower short side panel (3A) and the upper short side panel (3J), and a height (h8) of an upper part piece (4F) of each second side panel (4) corresponds to a height (h5) of each upper short side panel (3J), the plastic corrugated folding container, further comprising:

a joining piece (11) having a plastic corrugated plate shape panel (T) and a side piece (9B, 9B) extending perpendicularly from both sides of the plate shape panel, with a folding line (9A, 9A) interposed therebetween, and bending the side pieces (9B, 9B) in an inward direction;

wherein each joining piece (11) is stacked on each upper part piece (4F) of each second side panel (4), and the side pieces (9B, 9B) of each joining piece (11) are firmly fixed to each upper short side panel (3J) of each first side panel (3), and when folded, a storage portion reinforcing an upper part of a box body is formed.

Advantageous Effects of the Invention

According to the invention of the first aspect, a heating bar set to a prescribed temperature is used to bend the first side panels (3, 3) in the inward direction at each of the folding lines (1A) of the floor panel (2), and the heating bar at the prescribed temperature is used to bend the latch side panels (6, 6) in the inward direction at each of the folding lines (2B). The heating bar at the prescribed temperature is used to bend the engaging pieces (4B) in the outward direction at the folding lines (4D) of the second side panels (4), the bent state is held, and each of the engaging pieces (4B) of the second side panels (4) is engaged with the engaging holes (6A) of the latch side panels (6) to form the box body. By adopting such a configuration, a single panel member having rigidity is bent in an inward direction from the four edges of the box floor with heat applied, the side panels are erected, the bent shape is held, and the shape of the entire floor of the box is immobilized and held, and consequently sagging of the floor such as occurs in boxes of the prior art does not occur, and a sturdy box body having strength can be provided.

Conventional folding containers are folded by pressing from above the frame when folded, and therefore there is the issue that the column members are twisted and the corners of the column members catch on the latch panels at both ends of the latch side panels (6) of a conventional folding container, and the tip portions of the abutting pieces (7*d*) of the column members (7) ride up onto the inclined faces of the latch side panels (6) (see FIG. 13). According to the invention of the first aspect, both end portions of the latch side panels (6) are formed as inclined faces (α2) and as vertical faces (k) that continue the inclined faces (α2), and the corner parts (7*f*) of the connecting pieces (7*b*) are guided to the inside of the latch side panels (6) during folding. By adopting such a configuration, the abutting parts (7*d*) of the column members (7) are guided while making contact with the reverse side of the latch side panels (6) having the vertical faces (k), and riding-up onto the end parts of the latch side panels (6) of the abutting parts (7*d*) of the column members (7) is prevented (see FIG. 14).

According to the invention of the first aspect, a horizontal face (k1) and a vertical face (s) are provided at both ends of the lower short side panel (3A) of each first side panel (3), and an inclined face (α2) and a vertical face (k) are formed at both ends of each latch side panel (6) for the floor panel (2). The first side panels (3, 3) and the latch side panels (6, 6) are configured to bend in an inward direction, by applying a heating bar set to a prescribed temperature to each of the folding lines (1A) and each of the folding lines (2B) of the floor panel (2) and, the engaging pieces (4B) are configured to bend in an outward direction, by applying a heating bar set to a prescribed temperature to the folding line (4D) of each second side panels (4), and the engaging piece (4B) of each second side panel (4) is configured to engage with each engaging hole (6A) of the latch side panel (6). Consequently, during folding the vertical faces of the latch side panels do not come into contact with the abutting faces of the column members, and smooth folding is possible.

Heat is applied to the side panels from the folding lines of the floor panel and the side panels are erected by bending in the inward direction and immobilizing to form the box body, and therefore a sturdy box body in which sagging of the floor does not occur can be provided.

According to the second aspect of the invention, in the configuration of the folding container of the first aspect, a trapezoidal bending piece (3C), having an inclined face (α3), a vertical face (s), and a horizontal face (k2), is protrudingly provided at both ends of the lower short side panel (3A) of each first side panel (3), with a folding line (3D) interposed therebetween, the inclined face (α2) and the vertical face (k) are formed at both ends of each latch side panel (6) for the floor panel (2), the first side panels (3) and the latch side panels (6) which are provided at the floor panel (2) are configured to bend in the inward direction, by applying a heating bar set to a prescribed temperature to each of the folding lines (1A) and each of the folding lines (2B), the engaging pieces (4B) are configured to bend in the outward direction, by applying a heating bar set to a prescribed temperature to the folding line (4D) of each second side panel (4), and the bending pieces (3C) formed at both ends of each lower short side panel (3A) are configured to bend in the inward direction, by applying a heating bar set to a prescribed temperature to the folding lines (3D), and each end face portion of the inclined face (α2) and the inclined face (α3) and each end face portion of the vertical face (k) and of the vertical face (s) are heat-fused and welded. Through such a configuration, the second side panels and the latch side panels are erected from the four edges of the floor panel (2) and a sturdy box body without floor sagging is formed, the four corners of the box body are sealed, and a hygienic box body, into which foreign matter, dirt, and dust do not enter from outside the box body, can be provided.

According to the third aspect of the invention, in the configuration of the folding container of the first aspect, in addition to having advantageous effects similar to those of the first aspect, the advantageous effects described below can be obtained.

That is, the incision (3*a*) for folding is provided in each first side panel (3), a face panel portion (3*f*) is formed at both end parts of each incision (3*a*) by making an incision (3*e*, 3*e*, 3*e*) enclosing three sides of the periphery and leaving inside and outside faces of each first side panel, and a tip (3*h*) of the face panel portion (3*f*) and an end face edge (3*i*) of each first side panel (3) are formed in substantially a same plane. Hence, durability is imparted to the incision portions, and face panel portions (3*f*) are provided on the inside at both end parts of the incision portions of the incisions (3*a*) in the first side panels (3) in the amount of the thickness of the abutting pieces (7*d*) of the column members (7), and therefore the tips (3*h*) of the face panel portions (3*f*) are substantially flush with the end faces (3*i*) of the first side panels (3), and when the column members are attached with the face panel portions as reference, accurate positioning at all four places is possible, and moreover splitting of the face panel portions at the incision portions can be prevented, the durability of the incisions can be improved, and the frequency of use of folding can be improved.

According to the fourth aspect of the invention, in the configuration of the folding container of the first aspect, the incision (3*a*) for folding is provided in each first side panel (3), a face panel portion (3*f*) is formed at both end parts of each incision (3*a*) by making an incision (3*e*, 3*e*, 3*e*) enclosing three sides of the periphery and leaving inside and outside faces of each side panel, and the column members are attached aligned in the vertical direction with the tips of the face panel portions (3*f*) which are made to protrude outward in the amount of the thickness of the abutting pieces (7*d*) of the column members (7). Hence, the column member upper and lower attachment positions can be aligned therewith, and therefore shifts in the position of attachment of the column members are eliminated, lateral deformation of the column members when folding the column members is eliminated, and the box body can be smoothly folded.

According to the sixth aspect of the invention, in the configuration of the folding container of the first aspect, each first side panel (3) is provided on both sides of the floor panel (2), with the folding line (1A) interposed therebetween, each first side panel (3) is provided with a lower short side panel (3F), with the incision (3*b*) interposed therebetween, each first side panels (3) is provided with each upper short side panel (3B), with the incision (3*c*) interposed therebetween, each incision (3*a*) is formed at a position midway in the height direction of each first side panel (3) excluding the lower short side panel (3F) and the upper short side panel (3B), and a height (h0) of a latch side panel (6B) corresponds to a height (h) of the lower short side panel (3F) to form a storage part on the floor panel (2) in a folded state. Consequently, the storage portion reinforces the lower part of the box body in the folded state, and partitioning panels, lid members or similar which are easily lost during conveyance can be stored in the storage part to convey the folding container.

According to the seventh aspect of the invention, in the configuration of the folding container of the first aspect, each first side panel (3) is provided on both sides of the floor panel (2), with the folding line (1A) interposed therebetween, each first side panel (3) is provided with each lower short side panel (3A), with the incision (3*b*) interposed therebetween, each first side panel (3) is provided with an upper short side panel (3E), with the incision (3*c*) interposed therebetween, each incision (3*a*) is formed at a position midway in the height direction of the first side panels (3) excluding the lower short side panel (3A) and the upper short side panel (3E), and an upper part piece (4E) in which a height (h7) is increased is provided in each second side panel (4) corresponding to a height (h6) of the upper short side panel (3E), with each incision (4*a*) interposed therebetween, to provide a storage part on the second side panels (4, 4) in a folded state. Hence, even objects for storage with a high net height can be stored in the upper part of the box body, and partitioning panels, lid members or similar which are easily lost during conveyance can be stored together in the storage part when conveying the folding container.

According to the ninth aspect of the invention, in the configuration of the folding container of the first aspect, each first side panel (3) is provided on both sides of the floor panel (2), with the folding line (1A) interposed therebetween, each first side panel (3) is provided with a lower short side panel (3H), with the incision (3*b*) interposed therebetween, each first side panel (3) is provided with an upper short side panel (3M), with the incision (3*c*) interposed therebetween, the incision (3*a*) is formed at a position midway in the height direction of the first side panels (3) excluding the lower short side panel (3H) and the upper short side panel (3M), and the plastic corrugated folding container further comprising: a joining piece (5), placed on an end face (6*c*) of each latch side panels (6), and having a plastic corrugated plate shape panel (T) and a side piece (5C, 5C) extending perpendicularly from both sides of the plate shape panel, with a folding line (5E, 5E) interposed therebetween, and bending the side pieces (5C, 5C) in an inward direction, wherein each joining piece (5) is placed on the end face of each latch side panels (6) for the floor panel (2), and the side pieces (5C) of each joining piece (5) are firmly fixed to the lower short side panel (3H) of each first side panel (3), and when folded, a storage portion reinforcing a lower part of a box body is formed. Hence objects for storage can be stored in the lower part of the box body, and bulging of the box and separation of side panels can be prevented.

Moreover, the box body strength is increased, flexing of side panels in the assembled state is prevented, and shifting when box bodies are stacked is reduced.

Further, partitioning panels, lid members or similar which are easily lost during conveyance can be stored together in the storage part to convey the folding container.

According to the tenth aspect of the invention, in the configuration of the folding container of the first aspect, each first side panel (3) is provided on both sides of the floor panel (2), with the folding line (1A) interposed therebetween, each first side panel (3) is provided with the lower short side panels (3A), with the incisions (3*b*) interposed therebetween, each first side panel (3) is provided with the upper short side panel (3J) is provided, with the incision (3*c*) interposed therebetween, the incision (3*a*) is formed at a position midway in the height direction of the first side panels (3) excluding the height (h5) of the lower short side panel (3A) and the upper short side panel (3J), and a height (h8) of an upper part piece (4F) of each second side panel (4) corresponds to a height (h5) of each upper short side panel (3J), the plastic corrugated folding container, further comprising: a joining piece (11) having a plastic corrugated plate shape panel (T) and a side piece (9B, 9B) extending perpendicularly from both sides of the plate shape panel, with a folding line (9A, 9A) interposed therebetween, and bending the side pieces (9B, 9B) in an inward direction; wherein each joining piece (11) is stacked on each upper part piece (4F) of each second side panel (4), and the side pieces (9B, 9B) of each joining piece (11) are firmly fixed to each upper short side panel (3J) of each first side panel (3), and when folded, a storage portion reinforcing an upper part of a box body is formed.

Moreover, the box body strength is increased, flexing of side panels in the assembled state is prevented, and shifting when box bodies are stacked is reduced.

Further, partitioning panels, lid members or similar which are easily lost during conveyance can be stored together in the storage part to convey the folding container.

BRIEF DESCRIPTION OF THE DRAWINGS

FIG. 1(A) is a development plan view of a floor panel and first side panels with column members removed, and FIG. 1(B) is a front view of a second side panel, of the folding container in Example 1 the present invention;

FIG. 10(A) is an explanatory enlarged perspective view, with parts omitted, of the folding container before attachment of column members to first side panels, and FIG. 10(B) is an explanatory enlarged perspective view, with parts omitted, after attachment of column members to first side panels, in Example 2 of the present invention;

FIG. 15(A) is an enlarged explanatory view showing a case in which a face panel portion 3*f* is formed leaving inside and outside faces by making incisions 3*e*, 3*e*, 3*e* enclosing three sides of the periphery in both end parts of the incisions 3A for folding, the end face tip 3*h* of the face panel portion 3*f* and the end face edge 3*i* of the first side panel 3 are arranged in the same plane, and the column member is attached in a first side panel 3 of the present invention, and FIG. 15(B) is an enlarged explanatory view showing a case in which a face panel portion 3*g* is provided by making incisions 3*e*, 3*e*, 3*e*, 3*e* enclosing four sides of the periphery and leaving inside and outside faces in an intermediate portion of an incision for folding, and in a state of protrusion outside by the amount of the thickness of the abutting piece 7*d* of the column member from the end face tip 3*h* of the face panel portion 3*f* and the end face edge 3*i* of the first side panel 3, the column member is attached and the end face tip 3*h* of the face panel portion 3*f* and the end face of the abutting piece 7*d* of the column member are arranged to be in the same plane to attach the column member in a first side panel 3 of the present invention;

FIG. 17(A) is a development plan view of the first side panels and the floor panel, with the column members removed and the lower short side panel height of the first side panels made higher, and the height of the latch side panels of the floor panel made higher corresponding thereto, and FIG. 17(B) is a front view of a second side panel, of the folding container in Example 3 of the present invention;

FIG. 18(A) is a development plan view of the first side panels and the floor panel, with the column members removed and the upper short side panel height of the first side panels made higher, and FIG. 18(B) is a front view of a second side panel with the height of the upper part piece of the second side panel made higher corresponding to the height of the upper short side panel of the first side panels, of the folding container in Example 4 of the present invention;

FIG. 23(A) is a development plan view of the first side panels and the floor panel with the column members removed, and FIG. 23(B) is a front view of a second side panel, in a case in which the lower joining pieces are attached to the folding container in Example 6 of the present invention;

FIG. 24(C) is a front view of a plastic plate shape panel before bending both ends of the joining piece, and FIG. 24(D) is a plane view of a state in which both ends of the joining piece are bent, in the folding container in Example 6 of the present invention;

FIG. 25(E) is an enlarged explanatory perspective view, with parts omitted, of a state in which the joining piece is placed on and attached to the end face of the latch side panel of the second side panel, and FIG. 25(F) is an enlarged explanatory perspective view, with parts omitted, of a state in which the joining piece is placed on and attached to the end face of the latch side panel and the side piece is immobilized on the lower short side panel, in the folding container in Example 6 of the present invention;

FIG. 26(A) is a development plan view of the first side panels and the floor panels with the column members removed, with the height of the upper short side panels on both sides of the first side panels made higher, and FIG. 26(B) is a front view of a second side panel with the height of the upper part piece of the second side panel made higher corresponding to the height of the upper short side panel of the first side panel, in a case in which the joining pieces are attached onto a side face of the first side panels of the folding container in Example 7 of the present invention;

FIG. 27(C) is a front view of a plastic plate shape panel before formation of a joining piece, FIG. 27(D) is a plan view of joining piece formation, and FIG. 27(E) is an explanatory side view, with parts omitted, of a state in which the joining pieces are firmly fixed onto the side faces of the second side panels in a state in which the folding container is assembled, in Example 7 of the present invention;

DESCRIPTION OF THE EMBODIMENTS

Figure 2:
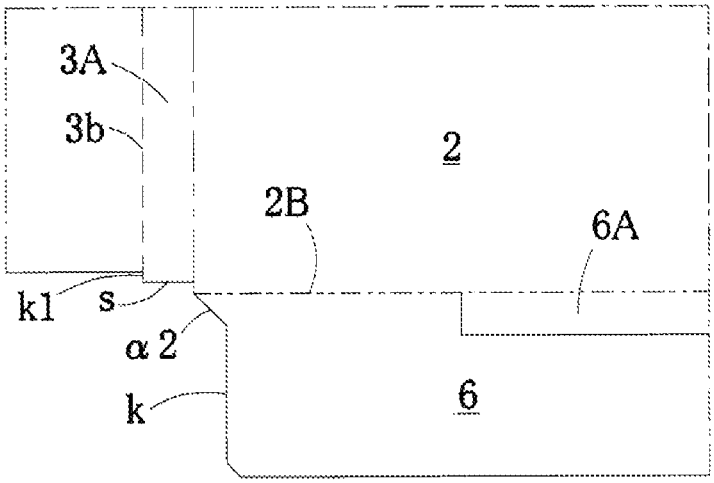
FIG. 2 is an expanded development plan view of principal parts, with parts omitted, of the folding container in Example 1 of the present invention.

The present invention is configured by applying a heating bar set to a prescribed temperature to each of the folding lines of the floor panel and heating and melting, and bending first side panels and latch side panels in the inward direction. the heating bar at the prescribed temperature is applied to the folding lines of the lower part of the second side panels and the engaging pieces are bent in the outward direction, and is configured such that each of the engaging pieces of the second side panels is engaged with the engaging holes in the latch side panels.

Through such a configuration, the box body is easily folded, the second side panels and the latch side panels are erected from the four edges of the floor panel with no sagging of the floor, and the box body can be assembled without catching of the latch side panels on the column members. Moreover, the four corners of the box body can be sealed, the incision places in the side panels can be reinforced, and a plastic corrugated folding container that when folded can store lid members, partitioning panels or similar can be realized.

EXAMPLE 1

The folding container 1 in Example 1 of the present invention is a plastic corrugated folding container in which first side panels 3 are connectedly provided with a floor panel 2, with the folding lines 1A interposed therebetween; lower short side panels 3A are provided in the first side panels 3, with incisions 3*b* interposed therebetween; upper short side panels 3B are provided in the first side panels 3, with incisions 3*c* interposed therebetween; incisions 3*a* are formed at a position midway in the height direction of the first side panel 3 excluding lower short side panels 3A and the upper short side panels 3B; latch side panels 6 having engaging holes 6A, 6A are formed on both ends of the floor panel 2, with the folding lines 2B interposed therebetween; in a pair of second side panels 4 that is attached to the floor panel 2, upper part pieces 4A are formed on an upper part with incisions 4*a* interposed therebetween, and engaging pieces 4B, 4B are provided on a lower part with the folding lines 4D interposed therebetween; column members 7 for supporting end parts of the first side panels 3 have sandwiching pieces 7*a* provided with stoppers 7*e* and being substantially U-shaped in cross section, connecting pieces 7*b*, and abutting pieces 7*d* continuous with the connecting pieces 7*b*, each of the column members 7 is separated into upper and lower column members across the incision 3*a* of the first side panel 3, and end parts of the first side panels 3 are firmly fixed by being sandwiched in the column members 7 and ultrasonic-welded, to obtain a plastic corrugated folding container that can be folded flat as a result of the incisions.

Further, horizontal faces k1 and vertical faces s are provided at both ends of each of the lower short side panels 3A of the first side panels 3, inclined faces α2 and vertical faces k are formed at both ends of each of the latch side panels 6 of the floor panel 2, a heating bar set to a prescribed temperature is applied to each of the folding lines 1A and folding lines 2B of the floor panel 2, and the first side panels 3, 3 and the latch side panels 6, 6 are bent in the inward direction;

a heating bar set to a prescribed temperature is applied to the folding lines 4D of the second side panels 4, and the engaging pieces 4B are bent in the outward direction, and each of the latching pieces 4B of the second side panels 4 is engaged with the engaging holes 6A of the latch side panels 6, to form a box body.

Consequently, during folding the vertical faces k of the latch side panels do not come into contact with the abutting pieces 7*d* of the column members, and smooth folding is possible.

The folding container 1 in Example 1 is a box body formed by applying heat from folding lines on the box floor and bending inward and immobilizing a single plastic corrugated panel having rigidity. A sturdy box body can be obtained having a strong floor member that does not sag as in conventional box bodies.

When folding the folding container, the folding container is pressed from above the frame 8 to fold. Consequently, at both ends of the first side panels 3, twisting of the column members and catching of the corner parts 7*f* of the column members on the inclined end faces 6*a* of the latch side panels 6, and riding-up of the tip portions of the abutting pieces 7*d* of the column members 7 onto the inclined faces of the latch side panels 6, must be prevented.

In the folding container 1 in Example 1, inclined faces α2 and vertical faces k are formed at both ends of the latch side panels 6 that are formed integrally with the floor panel 2, horizontal faces k1 and vertical faces s continuous with same are formed at both ends of the lower short side panels 3A (see FIG. 2), and during folding the corner parts 7*f* of the connecting pieces 7*b* are guided on the inside of the latch side panels 6. Hence, the abutting parts 7*d* of the column members 7 are guided while in contact with the reverse side of the latch side panels 6 having vertical faces k, and riding-up of the abutting parts 7*d* of the column members 7 onto the end parts 6*a* of the latch side panels 6 is deterred (see FIG. 13, FIG. 14).

EXAMPLE 2

Figure 4:
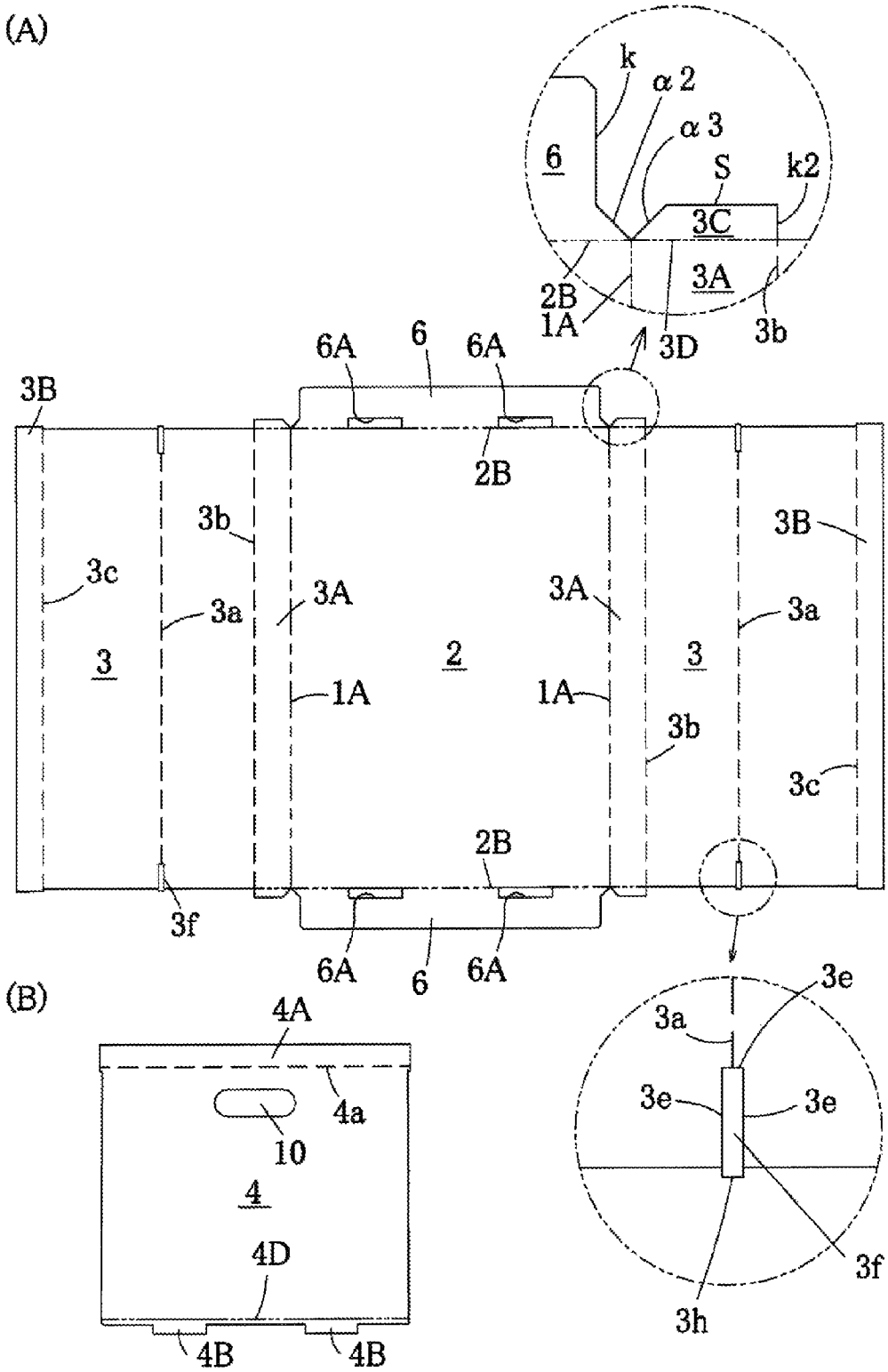
FIG. 4(A) is a development plan view of the floor panel and first side panels with the column members removed.
FIG. 4(B) is a front view of a second side panel, of the folding container in Example 2 of the present invention.

The folding container in Example 2 of the present invention is shown in FIG. 4. FIG. 4(A) is a development plan view of the floor panel and first side panels, and FIG. 4(B) is a front view of a second side panel.

Figure 5:
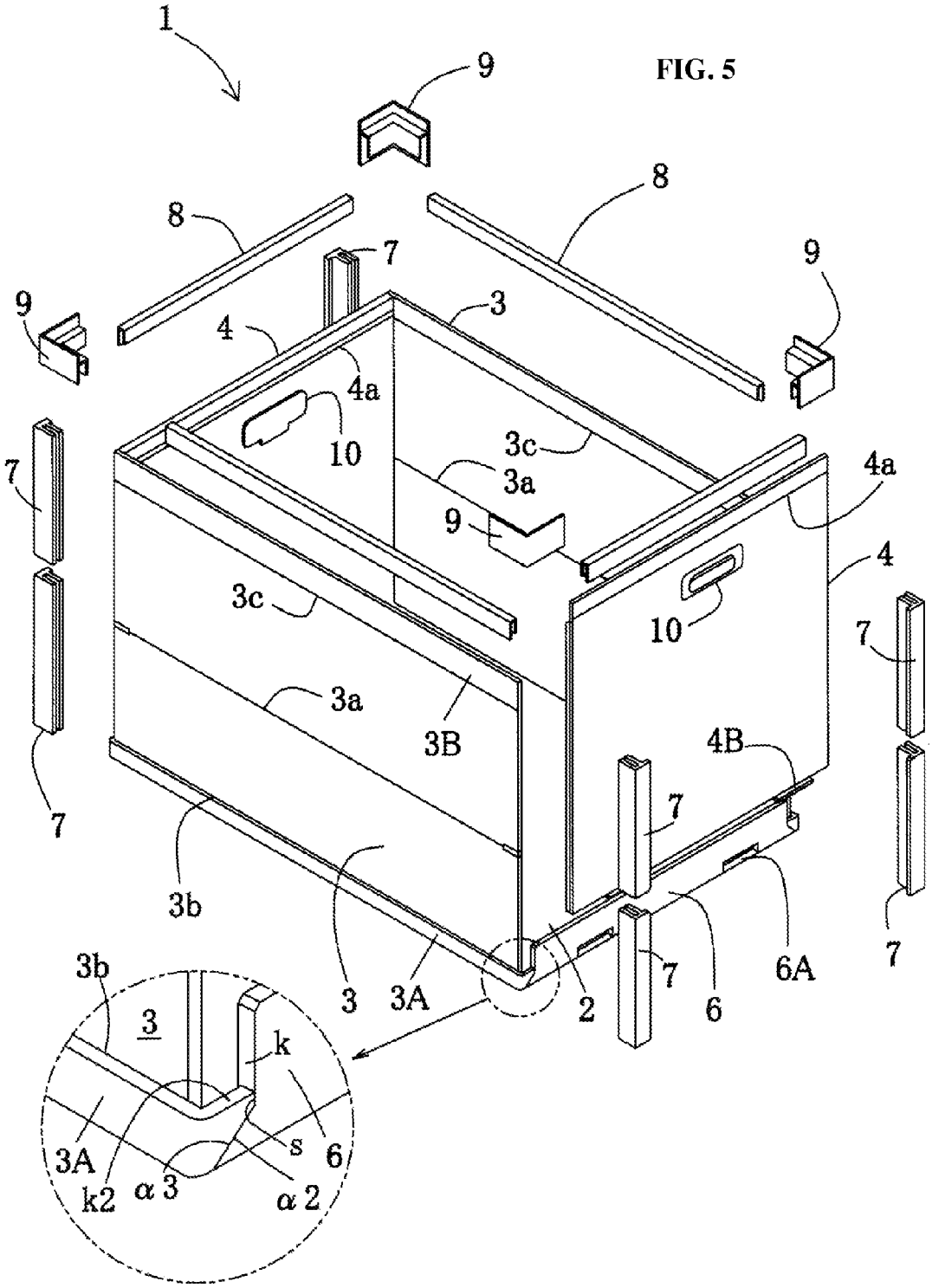
FIG. 5 is an exploded perspective view of the folding container in Example 2 of the present invention.
Figure 6:
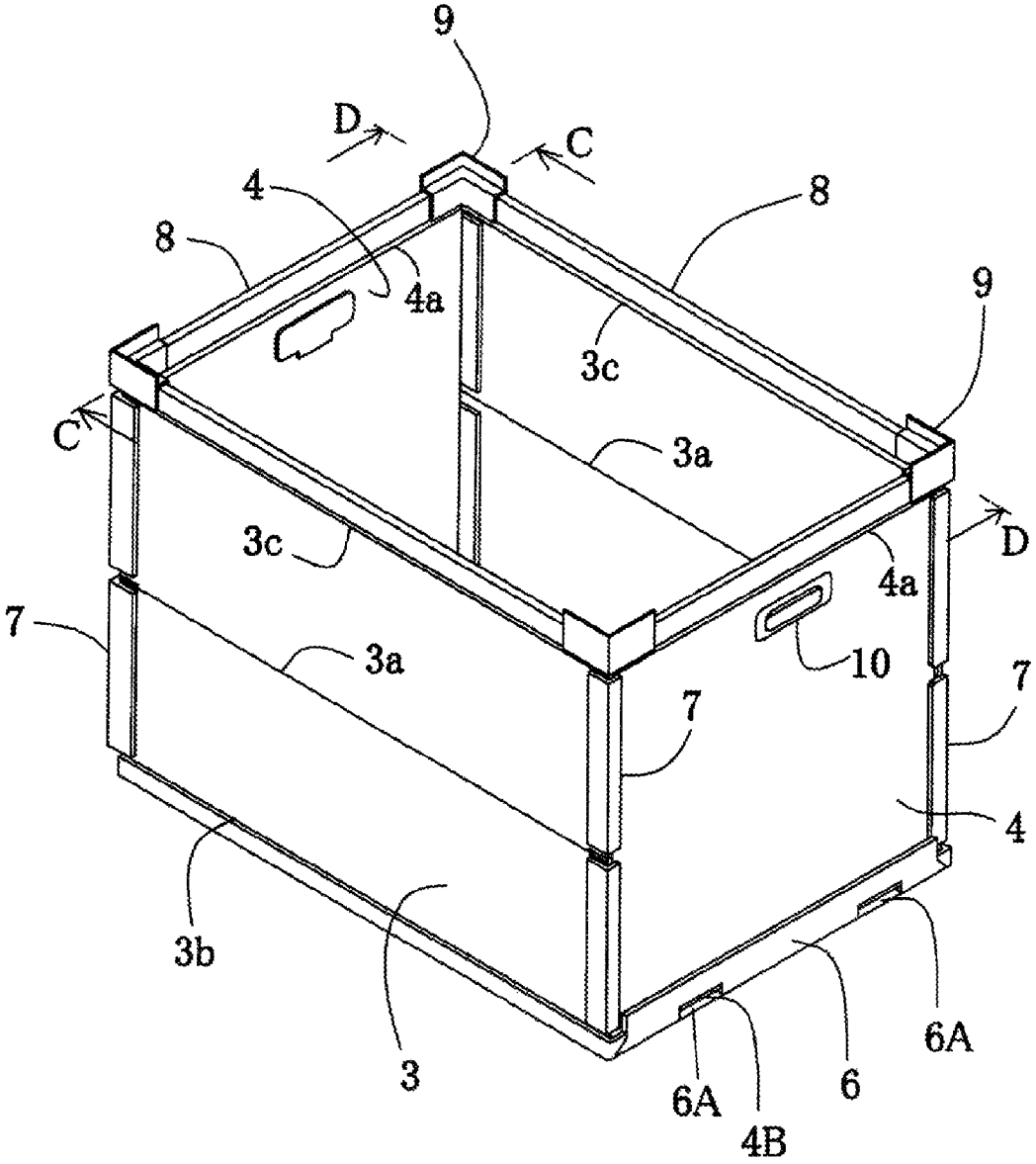
FIG. 6 is a perspective view of the folding container after assembly in Example 2 of the present invention.
Figure 7:
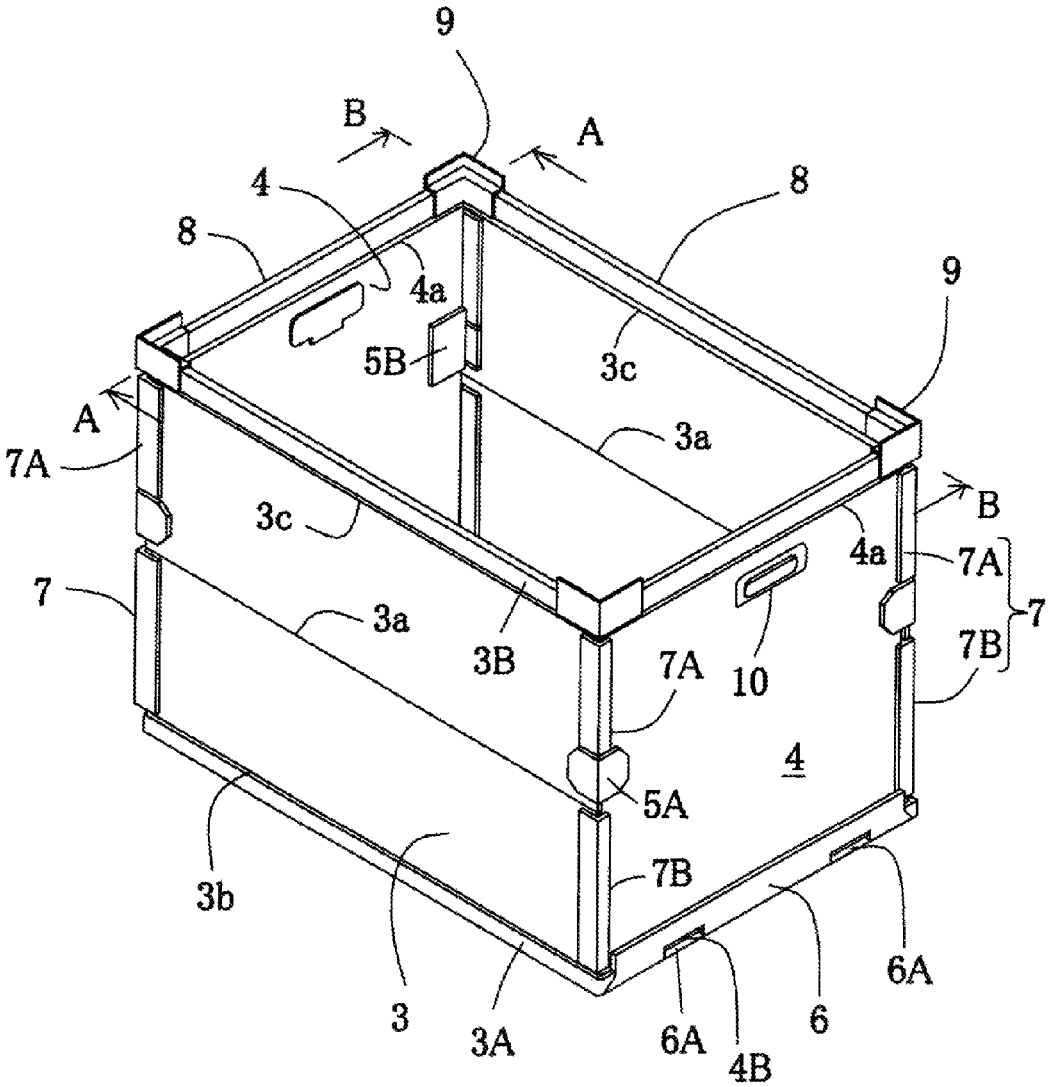
FIG. 7 is a perspective view of the assembled state of the folding container in Example 2 of the present invention, in a state in which the male connecting members 5A are attached below the short column members 7A in the column members of each of the first side panels 3, the female connecting members 5B are attached corresponding to the positions of attachment of the male connecting members 5A of the second side panels 4, and each of the male connecting members 5A and female connecting members 5B are configured to engage.

FIG. 5 is an exploded perspective view of the folding container in Example 2 of the present invention, and FIG. 6 is a perspective view of the folding container in Example 2 of the present invention after assembly.

As shown in FIG. 4(A), in Example 2 first side panels 3 are connectedly provided on both sides with the plastic corrugated panel of the floor panel 2, with the folding lines 1A interposed therebetween, the lower short side panels 3A are provided in the first side panels 3, with the incisions 3*b* interposed therebetween, the upper short side panels 3B are provided in the first side panels 3, with the incisions 3*c* interposed therebetween, and the incisions 3*a* are formed at a position midway in the height direction of the first side panel 3 excluding lower short side panels 3A and the upper short side panels 3B.

In the pair of second side panels 4 attached to the floor panel 2, upper part pieces 4A are formed in the upper parts, with the incisions 4*a* interposed therebetween, and engaging pieces 4B, 4B are provided in the lower parts, with the folding lines 4D interposed.

The column members 7 for supporting end parts of the first side panels 3 have sandwiching pieces 7*a* provided with stoppers 7*e* and being substantially U-shaped in cross section, connecting pieces 7*b*, and abutting pieces 7*d* continuous therewith.

Each of the column members 7 is separated into upper and lower column members across the incision 3*a* of the first side panel 3, and end parts of the first side panels 3 are firmly fixed by being sandwiched in the column members 7 and ultrasonically welded, to obtain a plastic corrugated folding container that can be folded flat as a result of the incisions.

In the plastic corrugated folding container in Example 2, trapezoidal bending pieces 3C having the inclined faces α3, the vertical faces s, and the horizontal faces k2 are protrudingly provided at both ends of each of the lower short side panels 3A of the first side panels 3, with the folding lines 3D interposed.

The inclined faces α2 and the vertical faces k are formed at both ends of each of the latch side panels 6 of the floor panel 2.

A heating bar set to a prescribed temperature is applied to each of the folding lines 1A and to each of the folding lines 2B, and each of the first side panels 3 provided at both ends of the floor panel 2 and each of the latch side panels 6 are bent in the inward direction. A heating bar set to a prescribed temperature is applied to the folding lines 4D of the pair of second side panels 4, and the engaging pieces 4B are bent in the outward direction, and a heating bar set to a prescribed temperature is applied to the folding lines 3D, and the bending pieces 3C formed at both ends of the lower short side panels 3A are bent in the inward direction. Each end face portion of the inclined faces α2 and of the inclined faces α3 and each end face portion of the vertical faces k and of the vertical faces s are heated, melted and welded. The four corners of the box body are sealed, and intrusion of dust and dirt is deterred.

Moreover, the inclined faces α2 and the vertical faces k are formed on both end portions of the latch side panels 6, and when the box body is folded, the connecting pieces 7*b* of the column members 7 are guided on the inside of the latch side panels 6, and consequently, the abutting parts 7*d* of the column members 7 are guided while in contact with the reverse side of the latch side panels 6 having the vertical faces k, and riding-up onto the end parts of the latch side panels 6 by the abutting parts 7*d* of the column members 7 can be deterred.

As shown in FIG. 5, the second side panels 4 disposed at edge parts on both sides of the first side panels 3 connected to the floor panel 2 are connectedly provided with the upper part pieces 4A in the upper end parts, with the incisions 4*a* interposed therebetween, and engaging pieces 4B, 4B protruding in the outward direction are provided in the lower end parts of the second side panels 4, with the folding lines 4D interposed. The engaging pieces 4B are provided corresponding to the engaging holes 6A, 6A in the latch side panels 6.

As shown in FIG. 4(B), FIG. 5 and FIG. 6, handhold parts 10 are installed in the upper center of the second side panels 4. In some cases, handhold parts 10 are not installed.

The synthetic resin panels used in the present invention use hollow synthetic resin panels not having directional properties. The floor panel 2, the first side panels 3, the second side panels 4, and the latch side panels 6 all use hollow synthetic resin panels not having directional properties. As an example, hollow laminated sheets with a three-layer structure (product name "Pla-Pearl", a registered trademark), obtained by heat-fusing two sheets, upper and lower, onto a polypropylene sheet vacuum-molded into cylinder shapes, were used with polyolefin foam boards.

In addition, for example a polypropylene resin can be used as a starting material in integrally molded corrugated plastic, welding together the pin tips of two polypropylene plastic sheets in which convexities with truncated cone shapes are disposed in a houndstooth pattern (commonly called "core cone"), then bonding together obverse-face panels to form a four-layer hollow plastic sheet with a honeycomb structure (TWIN CONE®) for use as corrugated plastic material.

Figure 29:
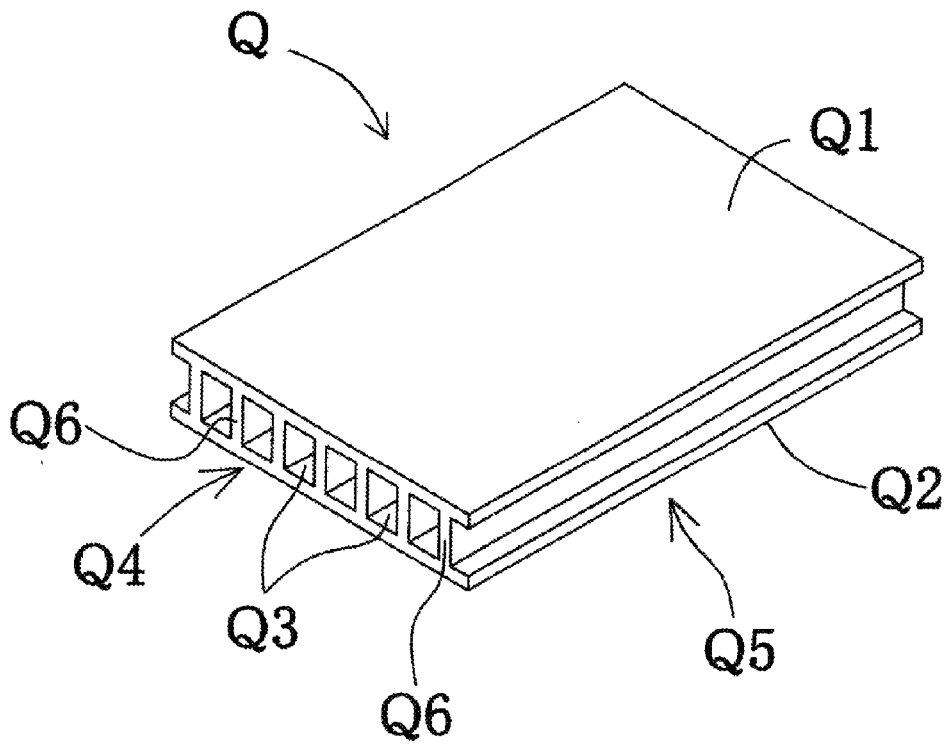

Moreover, for example the corrugated plastic can be the plastic corrugated panel Q, molded integrally using polypropylene resin as a starting material, shown in FIG. 29.

That is, the plastic corrugated panel Q has parallel flat panels which are an inside face Q1 and an outside face Q2, and ribs Q6 are provided at a prescribed interval in a gap between the flat panels.

Gaps between ribs form penetrating holes Q3.

An end face Q4, at which a plurality of ribs Q6 is disposed such that the ribs Q6 orthogonally intersect the inside face Q1 and the outside face Q2, has a shape of a harmonica mouthpiece, and at an end face Q5 on a side along the plurality of ribs Q6, a wall face is present in the gap between the flat panels.

In a case of a plastic corrugated panel having directional properties such as described above, if there is a resin quantity (wall thickness) for bending using heat, then bending is possible regardless of the directional properties.

That is, when applying a heating bar to a folding line and bending, bending can be performed without considering whether the position is a rib vertical direction.

Figure 28:
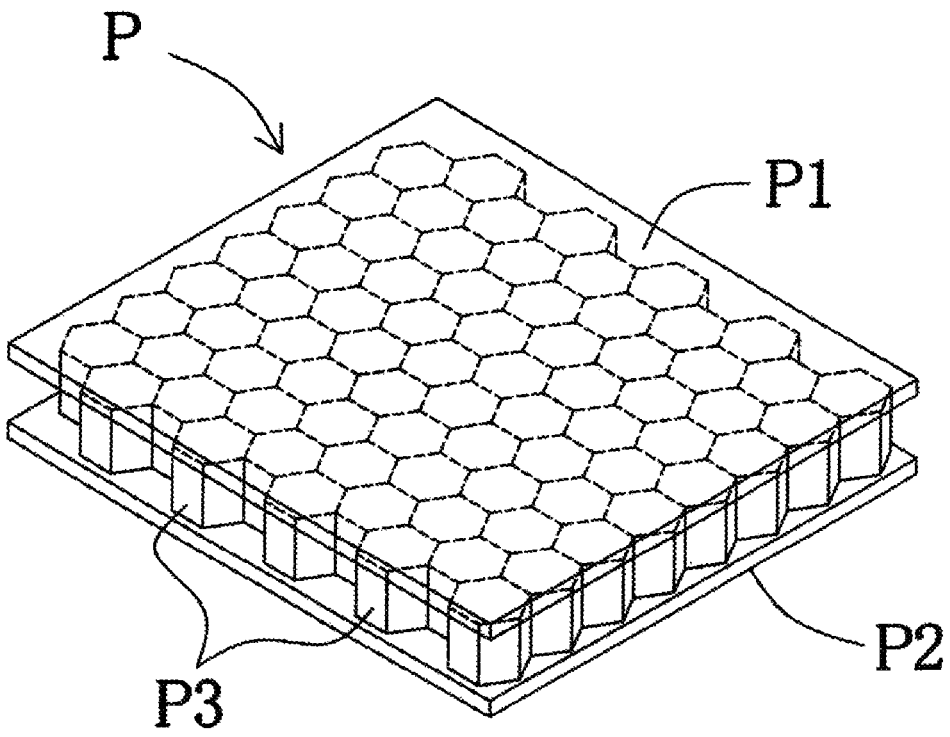
FIG. 28 is an enlarged perspective view explaining an example of a hollow plastic corrugated panel not having direction properties in a plastic corrugated piece; and, FIG. 29 is an enlarged explanatory perspective view of a plastic corrugated piece in which a plurality of ribs is arranged in a plastic corrugated panel, and an end face Q4 has a shape like the mouthpiece of a harmonica.

Further, as shown in FIG. 28, a plastic corrugated panel P (product name "Teccell" (a registered trademark), manufactured by Gifu Plastic Industry Co., Ltd.) has, as shown in FIG. 28, an inside face panel P1 and an outside face panel P2 that are parallel, and a core material P3 with a honeycomb structure is connectedly provided in the gap between the face panels, forming a hollow resin panel without directional properties.

In hollow corrugated plastic without directional properties, in the gap between sheets which are the parallel face panel portions that are the obverse-side (inside face) face panel P1 and the outside face panel P2, is disposed and connectedly provided thereto a core material P3 vacuum-molded into cylindrical shapes forming a honeycomb structure. Consequently, the synthetic resin panel has high resilience.

In the present invention, an "incision" is a configuration wherein only the obverse face panel P1 and the interior core material P3 are severed, without severing the outside face panel P2, to provide an incision so as to leave the outside face panel. A "folding line" is a portion at which heating, melting and bending are performed. A heating contact (bar) at a prescribed temperature (250° C. to 300° C.) is applied to the bending portion, and pressing along the folding line results in bending. Further, "welding" means heating and melting at places at which plastic panels are to be bonded to cause welding.

As shown in FIG. 4(A), a prescribed heating bar is applied to the folding lines of the second side panels 4 and the latch side panels 6, and the side panels are bent in the inward direction from the four edges and set upright, to form a box body the floor of which does not sag. The folding lines 2B are provided in the upper and lower end parts of the floor panel 2, and the latch side panels 6 are connectedly provided therewith. A prescribed heating bar is applied to the folding lines 2, and bending in the inward direction is performed for integral upward formation perpendicular to the floor panel 2.

The first side panels 3 are provided along the length direction of the floor panel 2 so as to orthogonally intersect the floor panel 2, with the incisions 3*b* interposed closer to the floor panel 2 interposed.

Further, the first side panels 3 are provided on both sides of the floor panel 2, with the folding lines 1A interposed therebetween, the lower short side panels 3A are provided in the first side panels 3, with the incisions 3*b* interposed therebetween, the upper short side panels 3B are provided in the first side panels 3, with the incisions 3*c* interposed therebetween, and the incisions 3*a* are formed at a position midway in the height direction of the first side panel 3 excluding lower short side panels 3A and the upper short side panels 3B.

The trapezoidal bending pieces 3C having the inclined faces α3, the vertical faces s, and the horizontal faces k2 are protrudingly provided at both ends of each of the lower short side panels 3A, with the folding lines 3D interposed. The inclined faces α2 and the vertical faces k are formed at both ends of each of the latch side panels 6 of the floor panel 2.

a prescribed heating bar is applied to the folding lines 3D and the bending pieces 3C are pressed in the inward direction and bent. Further, a heating bar set to a prescribed temperature is applied to the folding lines 2B and the latch side panels 6 of the floor panel 2 are pressed and bent in the inward direction. A heating bar set to a prescribed temperature is used to heat, melt and weld together each of the end face portions of the inclined faces α2 and the inclined faces α3, a heating bar set to a prescribed temperature is made to abut and to heat, melt and weld together each of the end face portions of the vertical faces k and the vertical faces s, and thereby the four corners of the box body can be closed (see FIG. 5).

The engaging pieces 4B of the second side panels 4 are configured to engage with each of the engaging holes 6A of the latch side panels 6 that are connected above and below with the floor panel 2. As shown in FIG. 4(B), the second side panels 4 are on the inside of the latch side panels 6 of the floor panel 2, and are disposed on both side parts not having the first side panels 3.

That is, the two second side panels 4 form both side faces of the box body.

Further, when at least two or more of the engaging holes 6A are provided, the engaging strength can be increased, and the latch side panels 6 and the second side panels 4 can be sturdily conjoined.

The upper part pieces 4A are formed in the second side panels 4, with the incisions 4*a* interposed therebetween, and the handhold parts 10 are formed below the incisions 4*a* in the second side panels 4.

The engaging parts 4B are provided in the lower end parts of the second side panels 4, protruding in the outward direction, with the folding lines 4D in the second side panels 4 interposed. The engaging parts 4B are provided corresponding to the engaging holes 6A in the latch side panels 6.

Further, the second side panels 4 are formed with horizontal widths made slightly greater below compared with above. Consequently, when the box body is assembled the first side panels 3, 3 are strongly pulled and stretched outward, and inadvertent separation of the second side panels 4 is prevented.

As shown in FIG. 5 and FIG. 6, the column members 7, 7 are installed at two places, above and below, across the incisions 3*a* of the first side panels 3.

As shown in FIG. 10(A), each column member 7 is formed from a synthetic resin, and is configured with a cross-section in substantially a U-shape by two sandwiching pieces 7*a* having a gap 7*c* and a connecting piece 7*b*. One of the sandwiching pieces 7*a* is provided with a stopper 7*e*.

An abutting piece 7*d* is formed, extending slightly, on one end part of the connecting piece 7*b* positioned on the side opposite the connecting piece 7*a* having the stopper 7*e*.

As shown in FIG. 10(A) and FIG. 10(B), the gaps 7*c* of the column members 7 formed in this way are fitted with the end parts of the first side panels 3. The column members 7 and the first side panels 3 are firmly fixed using hot melting, ultrasonic welding, or similar.

As shown in FIG. 15(A), the column members 7 are firmly fixed between the incisions 3*c* and the incisions 3*a* in the first side panels 3. The following configuration corresponds to the third aspect.

The incisions 3*a* for folding are provided in the first side panels 3, the incisions 3*e*, 3*e*, 3*e* are provided at both end parts of the incisions 3*a* enclosing three sides of the periphery and forming face panel portions 3*f* leaving inside and outside faces of the side panels. By forming tips 3*h* of the face panel portions 3*f* and end face edges 3*i* of the first side panels 3 in substantially the same plane, and attaching the column members to the end face edges 3*i* of the first side panels 3, the column members protrude by the thickness of the abutting parts 7*d*, and the tips 3*h* of the face panel portions 3*f* assume a depressed state.

The abutting parts 7*d* of the column members protrude beyond the tips 3*h* of the face panel portions 3*f*, but the column members are firmly fixed in the vertical direction according to the tips of the face panel portions 3*f* and are similarly firmly fixed in the vertical direction according to the tips of the face panel portions 3*f* of the other first side panel, and the upper and lower column members are firmly fixed at attachment positions according to the tips of the face panel portions 3*f*. Therefore, the column members can be accurately positioned at all four places in the four corners, during column member folding there is no lateral deformation of the column members, and folding can be performed smoothly.

The following configuration corresponds to the fourth aspect. The incisions 3*a* for folding are provided in the first side panels 3, and the incisions 3*e*, 3*e*, 3*e* are made at both end parts of the incisions 3*a* enclosing three sides of the periphery and forming the face panel portions 3*f* leaving inside and outside faces of the side panels. The tips 3*h* of the face panel portions 3*f* are formed protruding by the amount of the thickness of the abutting pieces 7*d* of the column members 7 so as to be in substantially the same plane. By attaching the column members to the end face edges 3*i* of the first side panels 3, the column members are attached with the abutting parts 7*d* and the tips 3*h* of the face panel portions 3*f* in substantially the same plane.

Thus, the column members 7 are firmly fixed in the vertical direction according to the tips of the face panel portions 3*f*, the column members 7 are similarly firmly fixed in the vertical direction according to the tips of the face panel portions 3*f* of the other first side panel, and the upper and lower column members 7 are firmly fixed at attachment positions according to the tips of the face panel portions 3*f*. Therefore, the column members 7 can be accurately positioned at all four places in the four corners, during folding of the column members 7 there is no lateral deformation of the column members 7, and folding can be performed smoothly.

However, in the case of a folding container in which only incisions are formed without forming conventional face panel portions 3*f*, firmly fixing the lower end parts of the upper column members 7 and the upper end parts of the lower column members slightly closer to the incisions 3*a* in the vertical direction by eye measure so as not to overlap the incisions 3*a*, and accurately positioning the column members midway laterally and fixing firmly, requires proficiency and takes time, and firmly fixing in the same place laterally is difficult.

Further, as shown in FIG. 5, the synthetic resin frame 8 with substantially a U-shape cross-section is fitted with the upper end parts of the first side panels 3 and firmly fixed. Further, as shown in FIG. 8, the frame is configured by connecting the inside pieces 8*a*, the outside pieces 8*c* that are slightly longer than the inside pieces 8*a*, and the upper-end faces 8*b*.

Figure 9:
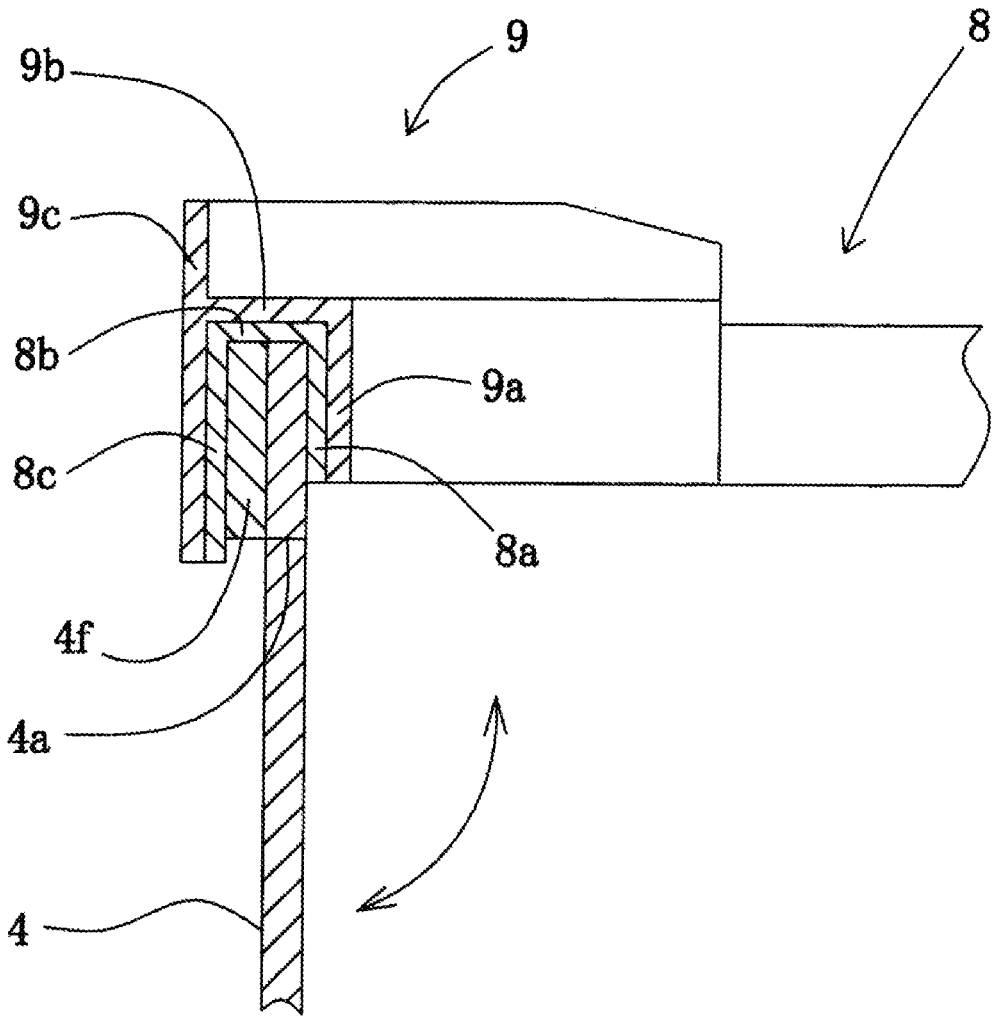
FIG. 9 is an enlarged C-C cross-sectional view, with parts omitted, of the folding container of FIG. 6 with a splice panel inserted, in Example 2 of the present invention.
Figure 11:
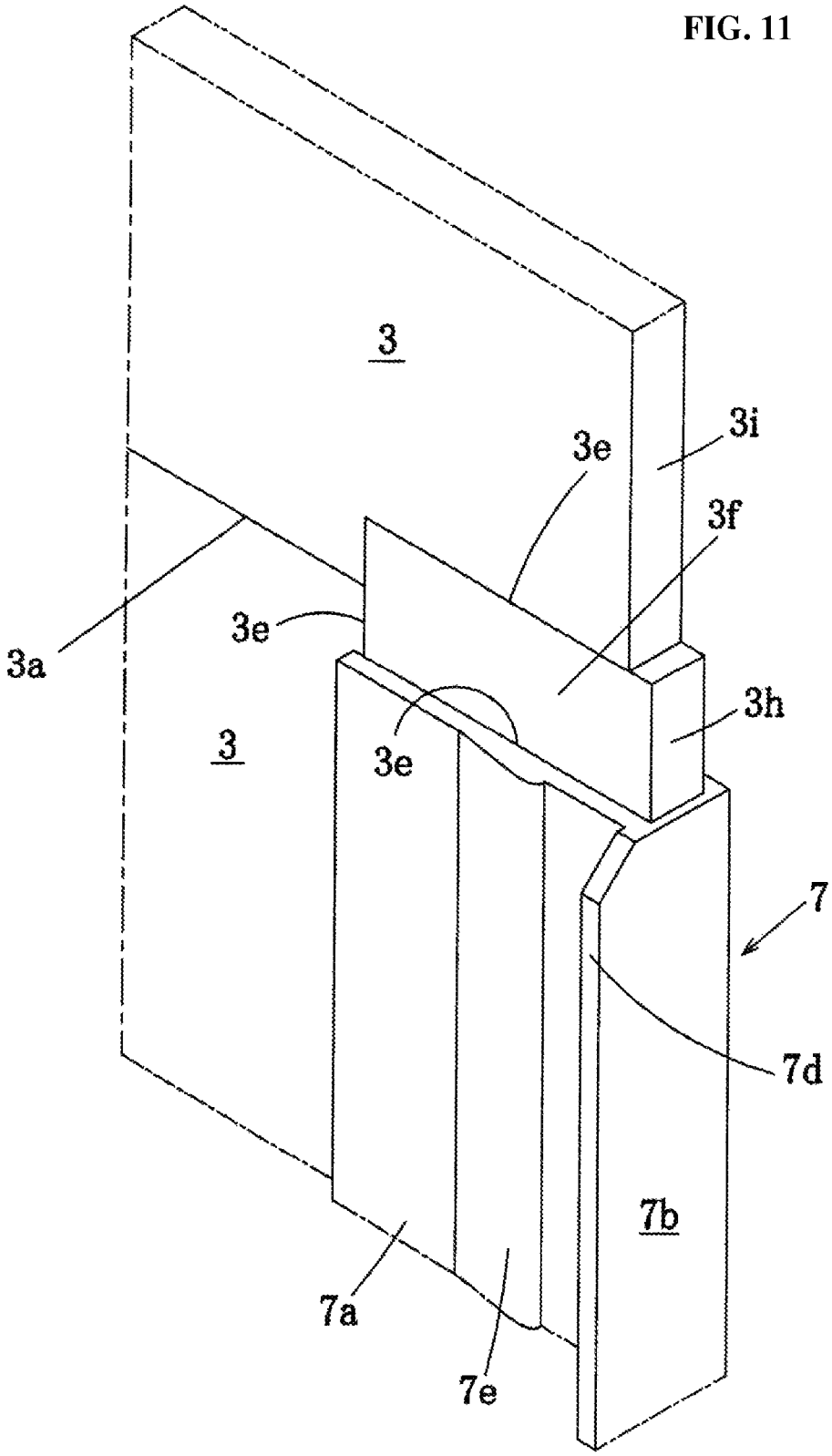
FIG. 11 is an enlarged perspective view, with parts omitted, showing a state in Example 3 of the present invention in which a column member 7 is attached to a tip 3*h* of a face panel portion 3*f* protruding slightly from the side panel end face edge in the lower part of a first side panel, and the tip 3*h* of the face panel portion 3*f* is slightly depressed.

As shown in FIG. 9, splice panels 4*f* are sandwiched by the upper end parts of the second side panels 4, and similarly to the upper end parts of the first side panels 3, the frame 8 is fitted therewith and firmly fixed.

In this way, similarly to Examples 1 and 2, with the frame 8 firmly fixed onto the upper end parts of the first side panels 3 and the second side panels 4, parts at both ends of the members of the frame 8 are supported at right angles by upper part corner members 9, as shown in FIGS. 5 and 6, and are fixed firmly by ultrasonic welding, thermal welding, rivets, or pins.

Figure 8:
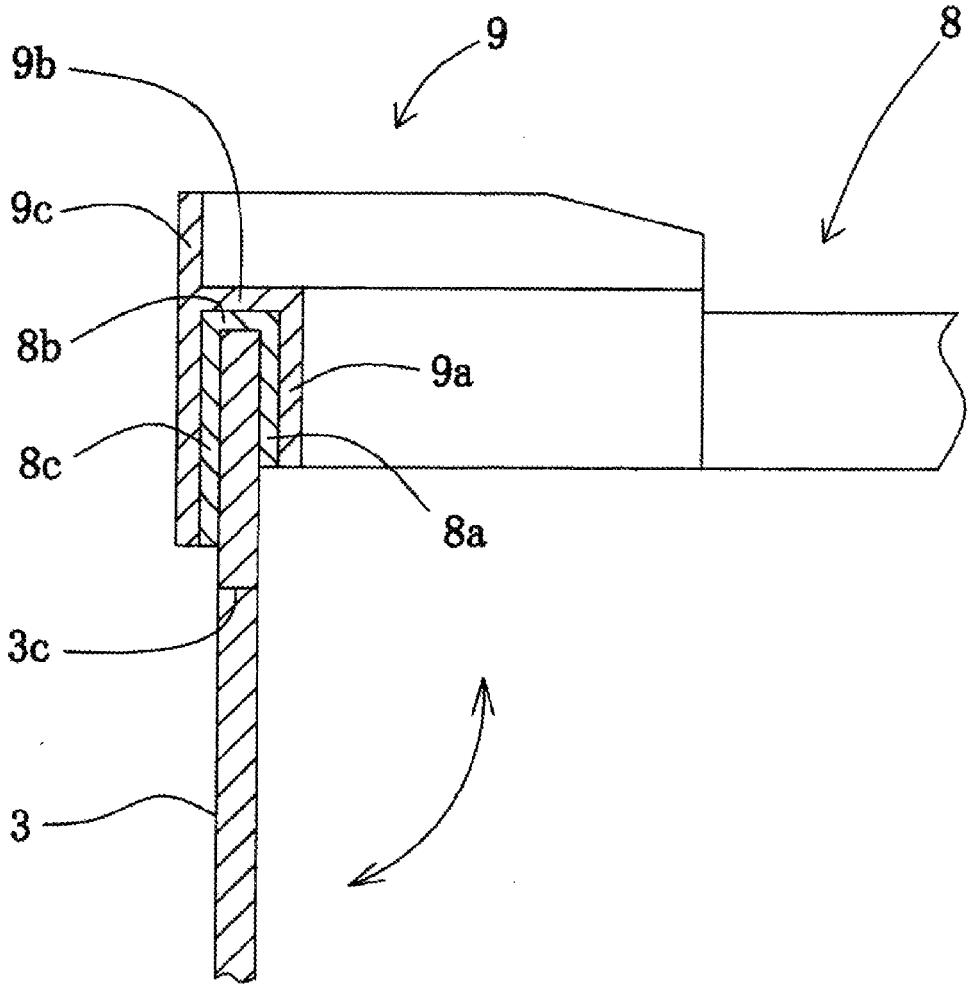
FIG. 8 is an enlarged D-D cross-sectional view, with parts omitted, of the folding container of FIG. 6 in Example 2 of the present invention.

As shown in FIG. 8, the upper part corner members 9 have inside pieces 9*a*, outside pieces 9*c* that are slightly longer than the inside pieces 9*a*, and upper end faces 9*b* that connect the two, and have substantially an h-shape cross-section.

The upper part corner members 9 adopt a configuration in which the outside pieces 9*c* extend upward beyond the upper end face 9*b*, and consequently shifting of a separate folding container that has been placed above the outside pieces 9*c* can be prevented.

It is desirable that the outside pieces 9*c* have substantially the same dimensions as the outside pieces 8*c* in the frame 8. As a result, as shown in FIG. 9, the incisions 4*a* in the second side panels 4 are positioned above the lower end parts of the outside pieces 9*c* in the upper part corner members 9, and consequently when inserting the second side panels 4 with the splice panels 4*f* sandwiched, the concern that a finger might be erroneously sandwiched by an incision 4*a* can be eliminated. The inside pieces 9*a* may have approximately the same dimensions as the inside pieces 8*a* in the frame 8.

In engagement of the upper part corner members 9 explained above, resin rivets may be used, but engagement of members, and sandwiching using elasticity, are also possible. In addition, crimping using ultrasonic welding, thermal welding, or similar is also possible.

Figure 12:
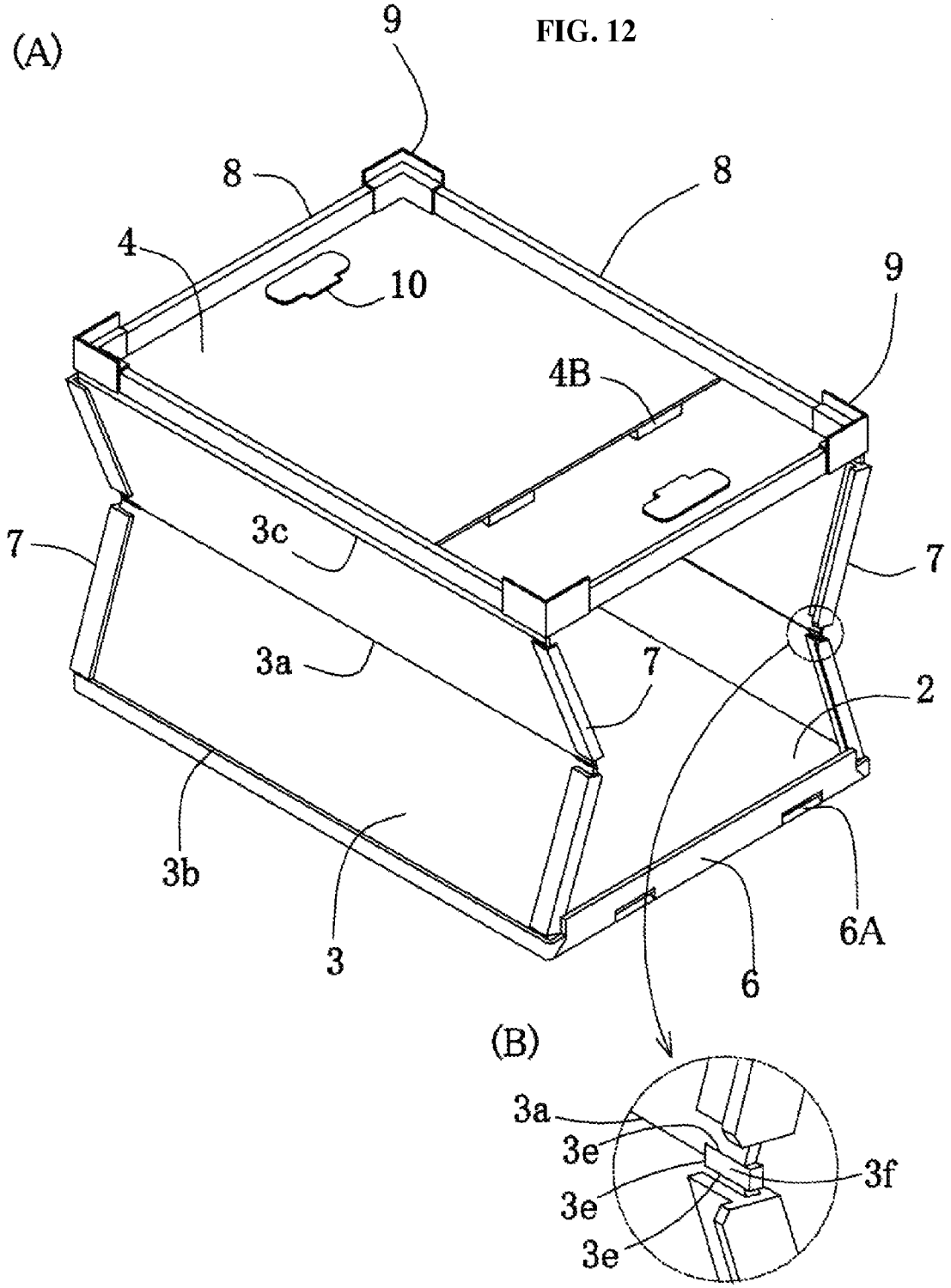
FIG. 12(A) is a perspective view showing a state midway in assembly or folding of the folding container.
FIG. 12(B) is a partial enlarged perspective view explaining a state of attachment of column members to face panel portions with incisions, in Example 2 of the present invention.
Figure 16:
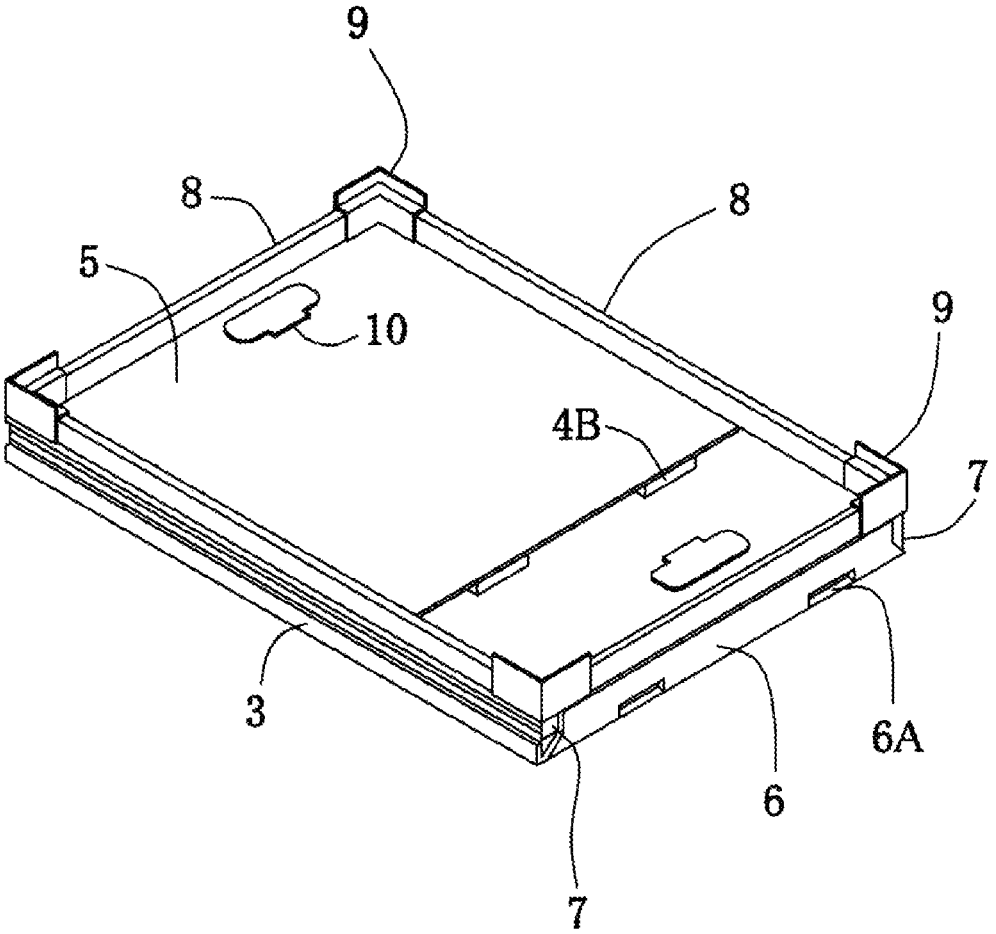
FIG. 16 is a perspective view of the folding container in the folded state in Example 2 of the present invention.

A folding container configured in this way is assembled as shown in FIG. 5 and FIG. 6, and is folded as shown in FIG. 12. Moreover, folding flat with a low net height is possible, as shown in FIG. 16.

Next, a method of assembly is explained. In the folded state as shown in FIG. 16, the upper part of the folding container is lifted upward, as shown in FIG. 12. The first side panels 3, which had been folded in the inward direction with the incisions 3*a* as a boundary, rise up.

In the state in which the first side panels 3 have risen up to be vertical, the incisions 4*a* in the two second side panels 4 that are folded in the upper part of the box body are bent in the outward direction and pressed downward, as shown in FIG. 12*the* second side panels 4 are pressed in the outward direction of the folding container 1, the end face parts of the second side panels 4 are made to pass over the stoppers 7*e* of the column members and abut the abutting pieces 7*d*, and by engaging the engaging pieces 4B of the second side panels 4 in the engaging holes 6A in the latch side panels 6, the folding container 1 is assembled (see FIG. 10).

In this state, the abutting pieces 7*d* in the column members 7 installed on the first side panels 3 and both end parts of the second side panels 4 are in a state of abutment. Breaking-away of the second side panels 4 in the outward direction of the folding container 1 can also be prevented by engagement of the latch side panels 6 and the second side panels 4, but by abutment of the stoppers 7*e* formed in the sandwiching pieces 7*a* with both end parts of the second side panels 4, additional prevention of breaking-away is possible.

Next, a method of folding is explained. In order to disengage the engaging pieces 4B of the second side panels 4 and the engaging holes 6A in the latch side panels 6 in the folding container 1 that has been assembled as shown in FIG. 6, the lower end parts of the second side panels 4 are pressed to the inside, and the incisions 4*a* in the second side panels 4, 4 are bent inwards and pressed upwards.

Next, as shown in FIG. 12, the incisions 3*a*, 3*b*, 3*c* in the first side panels 3, 3 are bent inwards, and the first side panels 3 are made to flex to the inside. As a result, the folding container 1 is folded, as shown in FIG. 16.

Figure 13:
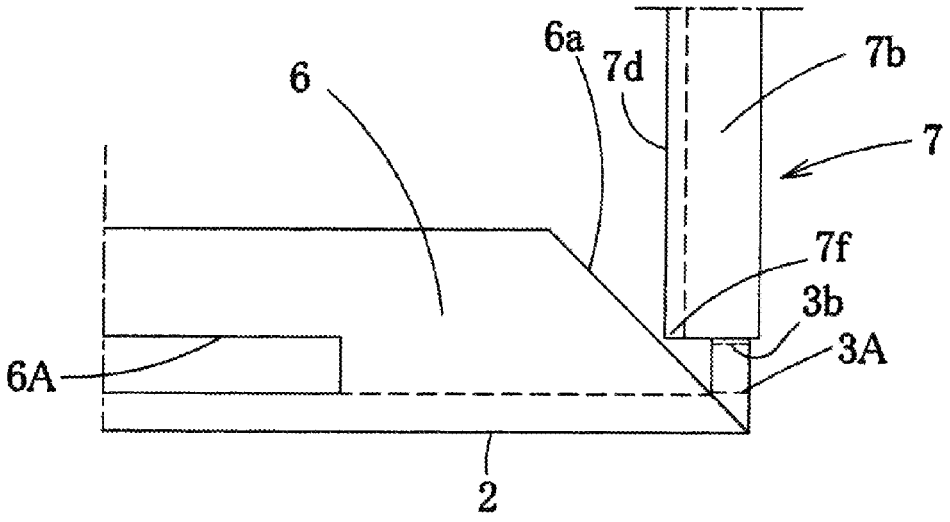
FIG. 13 is an enlarged view of principal parts explaining a state in which a latching member and a terminal end of a column member come into contact during folding of a folding container in an example of the prior art.
Figure 14:
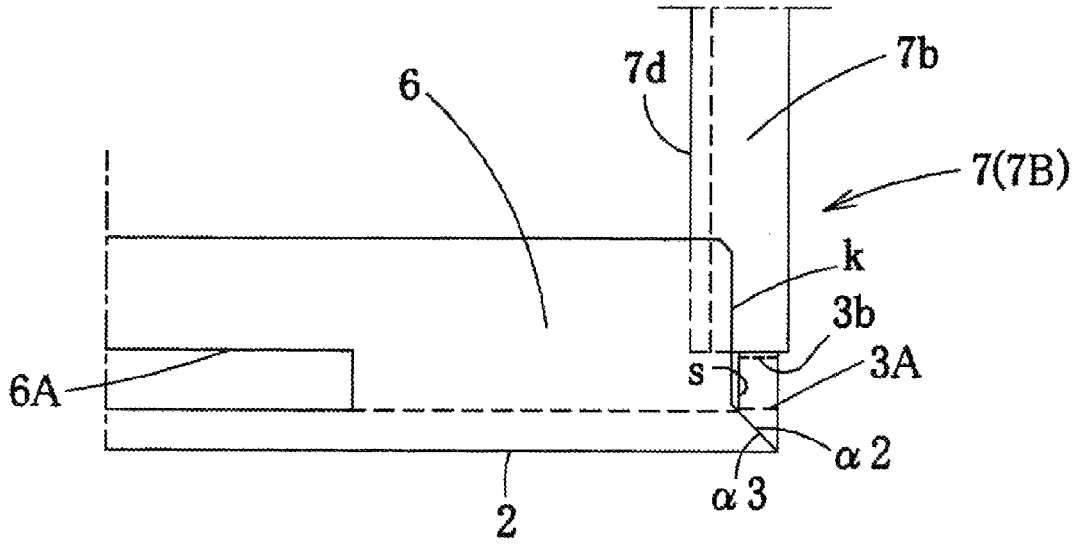
FIG. 14 is an enlarged view of principal parts explaining a state in which an end of a column member is accommodated in the inside of a latch member, and riding-up of the column members onto the latch side panels during folding does not occur, in the folding container in Example 2 of the present invention.

At this time, as shown in the example of the prior art in FIG. 13, there are cases in which the inclined upper faces 6*a* of the latch side panels 6 come into contact with the corner parts 7*f* of the column members 7 and ride up onto the latch side.

Figure 3:
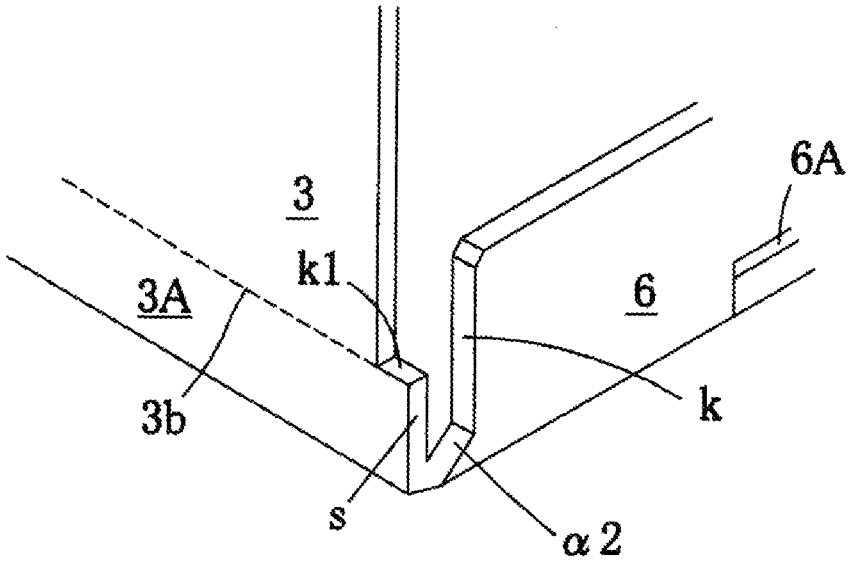
FIG. 3 is an expanded perspective view of principal parts, with parts omitted, of the assembled box body of the folding container in Example 1 of the present invention.

In the present invention, however, as shown in FIG. 2 and FIG. 3, the horizontal faces k1 and the vertical faces s are provided at both ends of each of the lower short side panels 3A of the first side panels 3, the inclined faces α2 and the vertical faces k are formed at both ends of each of the latch side panels 6 of the floor panel 2, a heating bar set to a prescribed temperature is applied to each of the folding lines 1A and the folding lines 2B of the floor panel 2, the first side panels 3, 3 and the latch side panels 6, 6 are bent in the inward direction, a heating bar set to a prescribed temperature is applied to the folding lines 4D of the second side panels 4 and the engaging pieces 4B are bent in the outward direction, each of the engaging pieces 4B of the second side panels 4 is engaged with the engaging holes 6A of the latch side panels 6, during folding the latch side panels do not make contact with the column members, and smooth folding is therefore possible.

The folding containers 1 of Example 1 and Example 2 of the present invention explained above use hollow laminated plastic corrugated panels, having a three-layer structure in which a sheet with cylindrical or conical shapes as a core and upper and lower sheets are heat-fused as shown in FIG. 28. Hence the panels are of light weight due to the hollow structure, have excellent bending rigidity, have excellent water resistance, moisture resistance, and chemical resistance, and moreover can be recycled and can improve loading properties. Consequently, without providing separate members, the first side panels 3, 3 and the latch side panels 6, 6 can be raised up from the four edges of the floor panel 2 and can be pressmolded using a heating bar set to a prescribed temperature integrally with the floor panel 2.

Further, the lower end part of the second side panels 4 is pressed to the inside and the incisions 4*a* of the second side panels 4, 4 are bent inwards and pressed upwards, so that while maintaining the strength of the floor panel 2 the number of components of the folding container 1 can be reduced.

Further, panel members are not limited to hollow laminated plastic corrugated panels having a three-layer structure and no directional properties such as in FIG. 28, and if the resin quantity (wall thickness) is sufficient to withstand bending with heat, plastic corrugated panels with directional properties such as that shown in FIG. 29 can be bent without regard to directional properties, and when applying a heating bar to the folding lines and bending, bending can be performed without considering whether the folding lines are positioned in a direction perpendicular to any ribs.

Further, because the column members 7 are installed at both end parts of the first side panels 3, when the folding container 1 is in the assembled state the column members 7 are present at each of the corner parts in four places, and consequently excellent load bearing properties are possible. Hence during transportation and similar, even when folding containers 1 are stacked, bowing of the first side panels 3 and the second side panels 4 in the folding container positioned below can be prevented. Hence, there are no longer concerns that tasks to fold the folding containers 1 are cumbersome.

Further, in the folded state the upper end parts of the latch side panels 6 abut the lower end parts of the outside pieces 8*c* in the frame 8, and consequently even when assembly and folding are repeated the folded state can always be uniformly preserved. Further, loads can be distributed at the upper end parts of the latch side panels 6, and consequently durability and load bearing properties are superior even in the folded state.

Further, at the place of each incision in Example 1, an incision is formed leaving the outside face, a face panel portion is provided on both end parts of the incision, and consequently the incision portion is partially strengthened and splitting at the incision is prevented.

When both ends of the latch side panels are folded into the container, the frame is pressed from above to perform folding, and consequently in a conventional folding container the column members are twisted, the corners of the column members 7 catch on the latch side panels 6, and the tip portions of the abutting pieces 7*d* of the column members 7 ride up on the obverse side of the latch side panels 6 (see FIG. 13).

Hence vertical faces k are formed at both end portions of the latch side panels 6 such that during folding the connecting pieces 7B of the column members 7 are guided on the inside of the latch side panels 6. Hence, the abutting parts 7*d* of the column members 7 are guided so as to make contact with the inside of the vertical faces k of the latch side panels 6 (see FIG. 14), and riding-up of the abutting parts 7*d* of the column members 7 onto the end parts of the latch side panels 6 is deterred.

As a result, there is no longer the need to use a rod-shape object or a finger to separate an abutting part 7 that has ridden up onto the obverse face of a latch side panel 6, and folding can be performed smoothly.

As shown in FIG. 15(B), in the present invention the incisions 3*e*, 3*e*, 3*e*, 3*e* are provided in intermediate portions of the incision portions, face panel portions 3*g* are formed leaving inside and outside faces of the side panels, and by providing the incision portions of the face panel portions 3*g* in a plurality of places, splitting at the incision portions in the case of long incision portions is prevented and durability is improved, the incisions 3*a* are made rugged, and the frequency of bending use is improved. Further, although not shown in the drawings, a similar advantageous effect can be obtained when the face panel portions 3*g* are provided in the intermediate portions of the other incisions 3*b*, 3*c*.

EXAMPLE 3

As shown in FIG. 17, Example 3 of the present invention is the folding container of the first aspect, characterized in that the first side panels 3 are formed on both sides of the floor panel 2, with the folding lines 1A interposed therebetween, the lower short side panels 3F are provided in the first side panels 3, with the incisions 3*b* interposed therebetween, the upper short side panels 3B are provided in the first side panels 3, with the incisions 3*c* interposed therebetween, the incisions 3*a* are formed at a position midway in the height direction of the first side panel 3 excluding the lower short side panels 3F and the upper short side panels 3B, the latch side panels 6B are formed at a height h0 corresponding to the height h of the lower short side panels 3F, and when folding is performed, a storage part is provided on the floor panel 2. the latch side panels 6B are formed in the floor panel 2 having a plurality of engaging holes 6A, with the folding lines 2B interposed therebetween, a plurality of engaging pieces 4B is provided in the lower end parts of the pair of second side panels 4, with the folding lines 4D interposed therebetween, handhold parts 10 are provided in upper parts of the second side panels 4, and upper part pieces 4A are connectedly provided, with the incisions 4*a* interposed.

Although not shown in the drawings, similarly to Examples 1 and 2, the column members 7 attached to the end parts of the first side panels 3 are formed having sandwiching pieces 71 having substantially a U-shaped cross-section and having stoppers, connecting pieces 7*b*, and abutting pieces 7*d* that are continuous with the connecting pieces 7*b*. The column members are divided into two members, upper and lower, with the incisions 3*a* in the first side panels 3 as a boundary, the column members are each sandwiched and firmly fixed, the column members are attached in the four corners of the box body, folding flat is made possible, and partitioning panels, lid members or similar that are easily lost during conveyance can be stored in a storage part that is formed on the floor panel in the folded state when conveying the folding container.

EXAMPLE 4

As shown in FIG. 18, Example 4 of the present invention is the folding container of the first aspect, characterized in that the first side panels 3 are formed on both sides of the floor panel 2, with the folding lines 1A interposed therebetween, the lower short side panels 3A are provided in the first side panels 3, with the incisions 3*b* interposed therebetween, the upper short side panels 3E having a height h6 are provided in the first side panels 3, with the incisions 3*c* interposed therebetween, the incisions 3*a* are formed at a position midway in the height direction of the first side panel 3 excluding lower short side panels 3A and the upper short side panels 3E, and upper part pieces 4E in which a height h7 is increased are provided in the pair of second side panels 4 in accordance therewith, with the incisions 4*a* interposed therebetween, to provide a storage part on the flipped-up second side panels 4, 4 when folded. Hence, similarly to Example 3, the column members are attached in the four corners of the box body, a storage part is formed in the upper part of the boxy body in the folded state, and therefore partitioning panels, lid members or similar that are easily lost during conveyance can be stored in the storage part and conveyed.

EXAMPLE 5

EXAMPLE 6

As shown in FIGS. 23 to 25, Example 6 of the present invention is the folding container of the first aspect, characterized in that the first side panels 3 are provided on both sides of the floor panel 2, with the folding lines 1A interposed therebetween, the lower short side panels 3H are provided in the first side panels 3, with the incisions 3*b* interposed therebetween, the upper short side panels 3M are provided in the first side panels 3, with the incisions 3*c* interposed therebetween, the incisions 3*a* are formed at a position midway in the height direction of the first side panel 3 excluding lower short side panels 3H and the upper short side panels 3M, the joining pieces 5 that are fixed firmly to the lower short side panels 3H of the first side panels 3 are provided with side pieces 5C, 5C on both sides of the plastic corrugated plate shape panel T, with folding lines 5E, 5E interposed therebetween, the side pieces 5C, 5C are extending perpendicularly from both sides of the plate shape panel and the side pieces are bent in the inward direction, the joining pieces 5 are placed on the end faces of the latch side panels 6 of the floor panel 2, the side pieces 5C of the joining pieces 5 are firmly fixed to the lower short side panels 3H of the first side panels 3 by ultrasonic welding 9C, and by forming the storage portion that reinforces the lower part of the box body when folded, objects for storage can be stored in the lower part of the box body when folded, and bulging of the box body and separation of the side panels are prevented.

Further, the boxy body strength is increased, flexing of side panels in the assembled state is prevented, and shifting when box bodies are stacked is reduced.

Further, partitioning panels, lid members or similar which are easily lost during conveyance can be stored together in the storage part to convey the folding container.

As shown in FIG. 26 and FIG. 27, Example 7 of the present invention is the folding container of the first aspect, characterized in that the first side panels 3 are provided on both sides of the floor panel 2, with the folding lines 1A interposed therebetween, the lower short side panels 3A are provided in the first side panels 3, with the incision 3*b* interposed therebetween, the upper short side panels 3J are provided in the first side panels 3, with the incision 3*c* interposed therebetween, the incision 3*a* is formed at a position midway in the height direction of the first side panel 3 excluding lower short side panels 3A and the upper short side panels 3J, the upper pieces 4F of the second side panels 4 are formed to a height h8 corresponding to the height h5 of the upper short side panels 3J, the joining pieces 11 having side pieces 9B which are firmly fixed to the upper short side panels 3J of the first side panels 3 are provided with the side panels 9B, 9B on both sides of the plastic corrugated plate shape panel T, with the folding lines 9A, 9A interposed therebetween, the side pieces 9B, 9B are extending perpendicularly from both sides of the plate shape panel and the side pieces are bent inwards, the joining pieces 11 are stacked on the upper part pieces 4F of the second side panels 4, the joining pieces 11 are stacked on the upper part pieces 4F of the second side panels 4 and the side pieces 9B, 9B of the joining pieces 11 are firmly fixed to the upper short side panels 3J of the first side panels 3 by ultrasonic welding 9C, and when folded, the upper part of the box body is reinforced and objects for storage can be stored in the upper part. Bulging of the box body and separation of the side panels are prevented, and the height of the storage part is increased; therefore, partitioning panels, lid members or similar which are easily lost during conveyance can be stored together in the storage part to convey the folding container.

Further, flexing of the side panels when assembled is prevented, shifting when box bodies are stacked is reduced, and the gap between the latch side panels and the second side panels can be closed.

As the means for attaching the side pieces of the joining pieces to the upper short side panels or the lower short side panels of the first side panels 3 in Examples 6 and 7, resin rivets, ultrasonic welding, thermal welding, pins, or other fixing means may be used.

The integrally molded plastic corrugated panel Q using a polypropylene resin as a starting material, shown in FIG. 29, has the parallel flat panels that are the inside face Q1 and the outside face Q2, and the ribs Q6 are provided at prescribed intervals in the gap between the flat panels, with penetrating holes Q3 formed in the gaps between the ribs 6. A plurality of the ribs Q6 is disposed so as to orthogonally intersect the inside face Q1 and the outside face Q2, forming a shape like a harmonica mouthpiece at the end face Q4, and at the end face Q5 on a side along the plurality of ribs Q6, a wall face is present in the gap between the flat panels.

Even when the plastic corrugated panels have a rib structure with directional properties as described above, if the inside face Q1, outside face Q2, and wall faces have adequate wall thickness and there is a large quantity of resin, bending using heat is possible regardless of the directional properties. That is, when applying a heating bar to the folding lines and bending, bending can be performed without considering whether the folding lines are positioned in a direction perpendicular to any ribs.

Key

1: folding container (box body)
1A: folding line
2: floor panel
2B: folding line
3: first side panel
3A: lower short side panel
3B: upper short side panel
3C: bending piece
3D: folding line
3E: upper short side panel
3F: lower short side panel
3G: upper short side panel
3H: lower short side panel
3J: upper short side panel
3K: upper short side panel
3L: lower short side panel
3M: upper short side panel
3*a*: incision
3*b*: incision
3*c*: incision
3*e*: incision
3*f*: face panel portion
3*g*: face panel portion
3*h*: tip
3*i*: end face edge
4: second side panel
4A: upper part piece
4B: engaging piece
4D: folding line
4E: upper part piece
4F: upper part piece
4*a*: incision
4*f*: splice panel

5: joining piece
5A: male connecting member
5B: female connecting member
5C: side piece
5E: folding line
6: latch side panel
6A: engaging hole
6B: tall latch side panel
6*a*: inclined end face
6*c*: end face
7: column member
7A: column member
7B: column member
7*a*: sandwiching piece
7*b*: connecting piece
7*c*: gap
7*d*: abutting piece
7*e*: stopper
7*f*: corner part
8: frame
8*a*: inside piece
8*b*: upper end face
8*c*: outside piece
9: upper part corner member
9A: folding line
9B: side piece
9C: ultrasonic welding
9*a*: inside piece
9*b*: upper end face
9*c*: outside piece
10: handhold part
11: joining piece
h: height
h0: height
h1: height
h2: height
h3: height
h4: height
h5: height
h6: height
h7: height
h8: height
k: vertical face
k1: horizontal face
k2: horizontal face
s: vertical face
α2: inclined face
α3: inclined face
T: plate shape panel
P: plastic corrugated piece
P1: inside face
P2: outside face
P3: core
Q: other plastic corrugated piece
Q1: inside face
Q2: outside face
Q3: penetrating hole
Q4: end face
Q5: end face
Q6: rib

The invention claimed is:

1. A plastic corrugated folding container comprising:

a first side panel, provided connectedly to each of two sides of a floor panel, with a folding line interposed therebetween, provided with a lower short side panel, with an incision interposed therebetween, and provided with an upper short side panel, with an incision interposed therebetween, wherein an incision is formed at a position midway in the height direction of each first side panel excluding the lower short side panel and the upper short side panel;

a latch side panel having an engaging hole, formed on each of two ends of the floor panel, with a folding line interposed therebetween;

a pair of second side panels attached to the floor panel, wherein an upper part piece is formed on an upper part of each second side panel with an incision interposed therebetween, and an engaging piece is provided on a lower part of each second side panel with a folding line interposed therebetween;

column members for supporting end parts of the first side panels, wherein each column member has a sandwiching piece provided with a stopper and being substantially U-shaped in cross section, a connecting piece, and an abutting piece continuous with the connecting piece, each column member is separated into upper and lower column members across the incision of each first side panel, and end parts of each first side panels are firmly fixed by being sandwiched in the column members, wherein each of the incisions enables flat folding, a horizontal face and a vertical face are provided at both ends of the lower short side panel of each first side panel, an inclined face and a vertical face are formed at both ends of each latch side panel for the floor panel, the first side panels and the latch side panels are configured to bend in an inward direction, the engaging pieces are configured to bend in an outward direction, and the engaging piece of each second side panel is configured to engage with each engaging hole of the latch side panel, to form a box body, and wherein a trapezoidal bending piece, having an inclined face, a vertical face, and a horizontal face, is protrudingly provided at both ends of the lower short side panel of each first side panel, with a folding line interposed therebetween, and the bending pieces formed at both ends of each lower short side panel are configured to bend in the inward direction, and each end face portion of the inclined face of the latch side panel and the inclined face of the bending piece, and each end face portion of the vertical face of the latch side panel and the vertical face of the lower short side panel are heat-fused and welded.

2. The plastic corrugated folding container according to claim 1, wherein the incision for folding is provided in each first side panel, a face panel portion is formed at both end parts of each incision by making an incision enclosing three sides of the periphery and leaving inside and outside faces of each side panel, and a tip of the face panel portion and the abutting piece of each column member is formed in substantially a same plane.

3. A plastic corrugated folding container comprising:

a first side panel, provided connectedly to each of two sides of a floor panel, with a folding line interposed therebetween, provided with a lower short side panel, with an incision interposed therebetween, and provided with an upper short side panel, with an incision interposed therebetween, wherein an incision is formed at a position midway in the height direction of each first side panel excluding the lower short side panel and the upper short side panel;

a latch side panel having an engaging hole, formed on each of two ends of the floor panel, with a folding line interposed therebetween;

a pair of second side panels attached to the floor panel, wherein an upper part piece is formed on an upper part of each second side panel with an incision interposed therebetween, and an engaging piece is provided on a lower part of each second side panel with a folding line interposed therebetween;

column members for supporting end parts of the first side panels, wherein each column member has a sandwiching piece provided with a stopper and being substantially U-shaped in cross section, a connecting piece, and an abutting piece continuous with the connecting piece, each column member is separated into upper and lower column members across the incision of each first side panel, and end parts of each first side panels are firmly fixed by being sandwiched in the column members, wherein each of the incisions enables flat folding, a horizontal face and a vertical face are provided at both ends of the lower short side panel of each first side panel, an inclined face and a vertical face are formed at both ends of each latch side panel for the floor panel, the first side panels and the latch side panels are configured to bend in an inward direction, the engaging pieces are configured to bend in an outward direction, and the engaging piece of each second side panel is configured to engage with each engaging hole of the latch side panel, to form a box body, and wherein the incision for folding is provided in each first side panel, a face panel portion is formed at both end parts of each incision by making an incision enclosing three sides of the periphery and leaving inside and outside faces of each side panel, and pg,61 a tip of the face panel portion and the abutting piece of each column member is formed in substantially a same plane.

* * * * *